US011892264B2

(12) United States Patent
Bryant, II

(10) Patent No.: US 11,892,264 B2
(45) **Date of Patent: *Feb. 6, 2024**

(54) SPEED LOADER FOR A REVOLVER

(71) Applicant: RevIndustries, LLC, Aurora, CO (US)

(72) Inventor: Earl Cleveland Bryant, II, Commerce City, CO (US)

(73) Assignee: RevIndustries, LLC, Aurora, CO (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/961,455

(22) Filed: Oct. 6, 2022

(65) Prior Publication Data

US 2023/0039265 A1 Feb. 9, 2023

Related U.S. Application Data

(63) Continuation of application No. 17/470,855, filed on Sep. 9, 2021, now Pat. No. 11,493,294.

(60) Provisional application No. 63/135,428, filed on Jan. 8, 2021, provisional application No. 63/076,118, filed on Sep. 9, 2020.

(51) Int. Cl.
*F41A 9/85* (2006.01)

(52) U.S. Cl.
CPC ..... *F41A 9/85* (2013.01)

(58) Field of Classification Search
CPC ..... F41A 9/85
USPC ..... 42/89
See application file for complete search history.

(56) References Cited

U.S. PATENT DOCUMENTS

| | | | |
|---|---|---|---|
| 202,613 | A | 4/1878 | White |
| 1,181,034 | A | 4/1916 | Prideaux |
| 1,228,505 | A | 6/1917 | Wesson |
| 1,480,812 | A | 1/1924 | Bazan |
| 1,559,825 | A | 11/1925 | Wilson |
| 2,396,184 | A | 3/1946 | Lima |
| 2,399,904 | A | 5/1946 | Baucum |
| 2,406,232 | A | 8/1946 | Lima |
| 2,508,820 | A | 5/1950 | Fraley |
| 3,150,459 | A | 9/1964 | Van Schoick |
| 3,197,907 | A | 8/1965 | Olson |
| 4,065,868 | A | 1/1978 | Johnson |
| 4,202,124 | A | 5/1980 | Switzer |
| 4,229,896 | A | 10/1980 | Jurich, III |
| 4,313,275 | A | 2/1982 | Switzer |

(Continued)

FOREIGN PATENT DOCUMENTS

GB 465114 4/1937

OTHER PUBLICATIONS

Notice of Allowance for U.S. Appl. No. 17/470,855, dated Jun. 30, 2022, 9 pages.

*Primary Examiner* — Bret Hayes
(74) *Attorney, Agent, or Firm* — Sheridan Ross P.C.

(57) ABSTRACT

A speed loading device and method of loading are provided. The device includes a main body with a first end, a second end, and a plurality of passages extending from the first end to the second end. Each passage receives a cartridge. The device includes a button movable relative to the main body and positioned proximate the first end of the main body. The device also includes a shaft connected to the button and positioned within the main body. The device includes a rotating disk having a plurality of radially extending arms. The rotating disk is positioned proximate to the second end of the main body.

19 Claims, 27 Drawing Sheets

(56) References Cited

U.S. PATENT DOCUMENTS

| | | | |
|---|---|---|---|
| 4,483,089 | A | 11/1984 | Johnson |
| 4,492,051 | A | 1/1985 | Switzer |
| 4,507,889 | A | 4/1985 | Allen |
| 4,572,415 | A | 2/1986 | Fehr |
| 4,697,369 | A | 10/1987 | Spears |
| 4,866,870 | A | 9/1989 | Johnson |
| 5,621,998 | A | 4/1997 | Norgaard |
| 5,842,299 | A | 12/1998 | Switzer et al. |
| 6,688,504 | B1 | 2/2004 | Kirkaldy |
| 9,612,097 | B1 | 4/2017 | Gross |
| 9,702,647 | B2 | 7/2017 | Head |
| 9,909,827 | B1 | 3/2018 | Higby |
| 10,209,018 | B1 | 2/2019 | Yaxley et al. |
| 10,222,156 | B2 | 3/2019 | Head |
| 10,539,384 | B1 | 1/2020 | Persico |
| 10,612,875 | B1 | 4/2020 | Roe |
| 11,493,294 | B2 | 11/2022 | Bryant, II |
| 2006/0101698 | A1 | 5/2006 | Lin |
| 2013/0036643 | A1 | 2/2013 | Lawing |
| 2014/0082984 | A1 | 3/2014 | Kent et al. |
| 2015/0369552 | A1 | 12/2015 | Earl |
| 2020/0064094 | A1 | 2/2020 | Litvinov et al. |
| 2023/0039265 | A1* | 2/2023 | Bryant, II ..... F41A 9/85 |

* cited by examiner

SPEED LOADER FOR A REVOLVER

CROSS-REFERENCE TO RELATED APPLICATIONS

The present application is a continuation of U.S. application Ser. No. 17/470,855, filed on Sep. 9, 2021, entitled "Speed Loader for a Revolver," which claims the benefit of and priority, under 35 U.S.C. § 119(e), to U.S. Provisional Application Ser. No. 63/076,118, filed on Sep. 9, 2020, entitled "Extendable, Plunger Shaft Actuated Speed Loader," and U.S. Provisional Application Ser. No. 63/135,428, filed on Jan. 8, 2021, entitled "Speed Loader for a Revolver," the entire disclosures of which are hereby incorporated herein by reference, in their entireties, for all that they teach and for all purposes.

FIELD OF THE DISCLOSURE

The present disclosure relates to devices and methods for loading projectiles into firearms, and specifically to speed loaders for loading cartridges into revolvers.

BACKGROUND

Reloading a firearm such as a revolver can be time consuming and inefficient. Typically, a revolver is loaded one cartridge at a time into a corresponding chamber of a cylinder when manually hand loaded. Still, conventional loading devices incorporate multiple steps and components, such as hand-rotated rods or screws located at the farthest end of a convention device from the revolver's cylinder. Some loading devices require the cylinder to be held stationary, while simultaneously holding the revolver and actuating the device. Further, conventional actuating rods and screws prevent configurations which allow stacking of additional cartridges in a longitudinal arrangement in comparison to embodiments of the configuration of the present disclosure and thus are limited to loading one row of cartridges at a time.

SUMMARY

This disclosure relates to a novel system, device, and methods for providing and using a speed loader for loading ammunition into firearms, and specifically into handheld revolvers. The novel speed loader provided herein allows for quickly loading a cylinder of a revolver and that automatically returns to its original locked state without any further action by the user.

In one embodiment of the speed loader, a plunger shaft is located at the first end of the device to actuate the release of cartridges into a revolver cylinder through the application of force between the plunger shaft and a revolver cylinder ratchet, the second and distal end having an interchangeable cover.

In some embodiments, a plunger shaft is located at the first end of the device to actuate the release of cartridges into a revolver cylinder through the application of force between the plunger shaft and a revolver cylinder ratchet, the second and distal end having an extender or an interchangeable extension that allows additional cartridges to be stacked along a longitudinal (i.e., vertical as shown in the figures herein) axis for increased capacity of cartridges.

Further, embodiments of the present disclosure provide advantages and/or alternatives over conventional revolver speed loading systems in that the present disclosure provides a configuration and an actuating method where the actuating component is located in a position to contact the revolver's cylinder ratchet, the application of force between the device and the revolver's cylinder ratchet results in a speed loading method, and the location of the actuating component allows an extension to be added to the speed loading device such that the extension increases the cartridge capacity of the speed loader.

In one embodiment, a speed loading device is provided comprising: a main body having a first end opposite a second end and a longitudinal axis therebetween; a plurality of cartridge passages in the main body extending parallel to the longitudinal axis; a button configured to actuate the speed loading device; a shaft interconnected on a first end to the button; a spring positioned around a portion of the shaft and proximate the button; a shaft cavity concentric with the longitudinal axis, in which the shaft, spring, and button are positioned; a pin interconnected to a second end of the shaft and extending outwardly in the radial direction from the shaft; a rotating disk with a plurality of arms and recesses between arms; and a disk cylinder connected to the rotating disk, the disk cylinder having an angled slot, wherein the pin of the shaft is positioned in the angled slot.

In some embodiments, the speed loading device further comprises an extender connected to the second end of the main body, the extender comprising one or more additional rows of cartridges. In some embodiments, translational movement of the shaft pushes the pin along the angled slot, thereby rotating the disk cylinder and the disk between a first position and a second position. In some embodiments, the spring biases the disk in the first position. In some embodiments, the plurality of arms engages cartridges stored in the plurality of cartridge passages when the disk is in the first position and wherein the plurality of arms disengages the cartridges stored in the plurality of cartridge passages when the disk is in the second position. In some embodiments, the plurality of arms is aligned with passages of the extender, thereby holding cartridges in the extender, when the disk is in the first position, and the recesses are aligned with the passages of the extender, thereby allowing cartridges in the extender to enter passages of the main body, when the disk is in the second position. In some embodiments, the device further comprises a cover configured to cover the first end of the main body.

A speed loading device is provided comprising: a main body comprising a first end opposite a second end, and a plurality of passages extending from the first end to the second end, each passage configured to receive a cartridge; a button movable relative to the main body and positioned proximate the first end of the main body, the button configured to actuate the speed loading device; a shaft connected to the button and positioned within the main body; a disk having a plurality of radially extending arms and recesses formed between adjacent arms, the disk positioned proximate to the second end of the main body, the disk configured to rotate; and a disk cylinder connected to the disk and the shaft, wherein translational movement of the shaft rotates the disk cylinder and the disk between a first position and a second position.

In some embodiments, the disk cylinder comprises at least one slot and the shaft comprises at least one pin receivable in the at least one slot, the at least one slot disposed at an angle, wherein translational movement of the shaft moves the at least one pin along the at least one slot, thereby rotating the disk cylinder. In some embodiments, wherein the plurality of arms engages cartridges stored in the plurality of cartridge passages when the disk is in the first position, and the plurality of arms disengages the cartridges stored in the plurality of cartridge passages when the disk is in the second position. In some embodiments, the device further comprises an extender connected to the second end, the extender comprising one or more additional rows of cartridges. In some embodiments, the plurality of arms is aligned with passages of the extender, thereby holding cartridges in the extender, when the disk is in the first position, and the recesses are aligned with the passages of the extender, thereby allowing cartridges in the extender to enter the passages of the main body, when the disk is in the second position. In some embodiments, the device further comprises a spring positioned around a portion of the shaft and wherein the spring biases the disk in the first position. In some embodiments, the device further comprises a cover configured to cover the first end of the main body.

In one embodiment, a method of loading a revolver cylinder is provided comprising: providing a speed loading device having a main body with a first end, a second end, and a plurality of passages extending from the first end to the second end, each passage comprising a cartridge; aligning the cartridges with passages in the revolver cylinder; pressing the speed loading device downward on the revolver cylinder; moving a button into the main body, which moves a shaft upward and into the speed loading device relative to the main body such that the shaft is closer to the second end of the main body than it was in its starting position; sliding a pin connected to the shaft along a slot in a disk cylinder, the disk cylinder connected to a rotating disk with a plurality of radially extending arms; rotating the rotating disk such that the plurality of radially extending arms are not extending into the plurality of passages in the main body; dropping the cartridges into the passages in the revolver cylinder; and rotating the rotating disk back to its starting position where the plurality of radially extending arms are extending into the plurality of passages in the main body.

In one embodiment, a method of loading a revolver cylinder is provided comprising: providing a speed loading device comprising: a main body with a first end, a second end, and a plurality of passages extending from the first end to the second end, each passage comprising a cartridge; a button movable relative to the main body and positioned proximate the first end of the main body; a shaft connected to the button and positioned within the main body; and a rotating disk having a plurality of radially extending arms, the rotating disk positioned proximate to the second end of the main body; aligning the cartridges with passages in the revolver cylinder; pressing the first end of the main body of the speed loading device downward on the revolver cylinder such that the main body moves downward and the button moves at least partly into the main body, which moves the shaft closer to the second end of the main body; rotating the rotating disk from a first locked positioned where the plurality of radially extending arms are extending into the plurality of passages in the main body to a second released position where a majority of each radially extending arm is not extending into the plurality of passages in the main body; dropping the cartridges into the passages in the revolver cylinder; pulling the speed loader device away from the revolver cylinder; and rotating the rotating disk back to the first locked position, which concurrently moves the button and shaft back to their starting positions relative to the main body.

In some embodiments the speed loading device further comprises an extender connected to the second end, the extender comprising one or more additional rows of cartridges. In some embodiments, the method further comprises receiving a row of cartridges from the extender to the passages of the main body. In some embodiments, the speed loading device further comprises a disk cylinder connected to the rotating disk, wherein the disk cylinder comprises at least one slot having a first end and a second end, and wherein the shaft comprises at least one pin receivable by the at least one slot. In some embodiments, rotating the rotating disk from the first locked position to the second released position comprises translating the shaft from a first position to a second position, wherein the at least one pin is moved from the first end of the at last one slot to the second end of the at least one slot. In some embodiments, the at least one slot is angled, thereby movement of the at least one pin from the first end to the second end causes the disk cylinder and the rotating disk to rotate.

The phrases "at least one," "one or more," and "and/or," as used herein, are open-ended expressions that are both conjunctive and disjunctive in operation. For example, each of the expressions "at least one of A, B and C," "at least one of A, B, or C," "one or more of A, B, and C," "one or more of A, B, or C," and "A, B, and/or C" means A alone, B alone, C alone, A and B together, A and C together, B and C together, or A, B, and C together.

Unless otherwise indicated, all numbers expressing quantities, dimensions, conditions, and so forth used in the specification and claims are to be understood as being modified in all instances by the term "about".

The term "a" or "an" entity, as used herein, refers to one or more of that entity. As such, the terms "a" (or "an"), "one or more," and "at least one" can be used interchangeably herein.

The use of "including," "comprising," or "having" and variations thereof herein is meant to encompass the items listed thereafter and equivalents thereof as well as additional items. Accordingly, the terms "including," "comprising," or "having" and variations thereof can be used interchangeably herein.

It shall be understood that the term "means" as used herein shall be given its broadest possible interpretation in accordance with 35 U.S.C. § 112(f). Accordingly, a claim incorporating the term "means" shall cover all structures, materials, or acts set forth herein, and all of the equivalents thereof. Further, the structures, materials, or acts and the equivalents thereof shall include all those described in the summary of the invention, brief description of the drawings, detailed description, abstract, and claims themselves.

These and other advantages will be apparent from the disclosure of the invention(s) contained herein. The above-described embodiments, objectives, and configurations are neither complete nor exhaustive. The Summary of the Invention is neither intended nor should it be construed as being representative of the full extent and scope of the present invention. Moreover, references made herein to "the present invention" or aspects thereof should be understood to mean certain embodiments of the present invention and should not necessarily be construed as limiting all embodiments to a particular description. The present invention is set forth in various levels of detail in the Summary of the Invention as well as in the attached drawings and the Detailed Description and no limitation as to the scope of the present invention is intended by either the inclusion or non-inclusion of elements, components, etc. in this Summary of the Invention. Additional aspects of the present invention will become more readily apparent from the Detailed Description, particularly when taken together with the drawings.

Any one or more aspects described herein can be combined with any other one or more aspects described herein.

Any one or more features described herein can be combined with any other one or more features described herein. Any one or more embodiments described herein can be combined with any other one or more embodiments described herein. It is to be appreciated that any feature described herein can be claimed in combination with any other feature(s) as described herein, regardless of whether the features come from the same described embodiment.

BRIEF DESCRIPTION OF THE SEVERAL VIEWS OF THE DRAWINGS

The accompanying drawings are incorporated into and form a part of the specification to illustrate several examples of the present disclosure. These drawings, together with the description, explain the principles of the disclosure. The drawings simply illustrate preferred and alternative examples of how the disclosure can be made and used and are not to be construed as limiting the disclosure to only the illustrated and described examples. Further features and advantages will become apparent from the following, more detailed, description of the various aspects, embodiments, and configurations of the disclosure, as illustrated by the drawings referenced below.

DETAILED DESCRIPTION

Although the following text sets forth a detailed description of numerous different embodiments, it should be understood that the legal scope of the description is defined by the words of the claims set forth at the end of this disclosure. The detailed description is to be construed as exemplary only and does not describe every possible embodiment since describing every possible embodiment would be impractical, if not impossible. Numerous alternative embodiments could be implemented, using either current technology or technology developed after the filing date of this patent, which would still fall within the scope of the claims.

Embodiments of the present disclosure will now be discussed below with reference to the figures. The present disclosure is not limited to use of any particular materials, combination of materials, means of connecting components to form the device, exact dimensions of the device and device's components, or exact shape of the device and may vary as necessary while adhering to the component arrangement, component attributes, methods, and function of the present disclosure.

Figure 1:
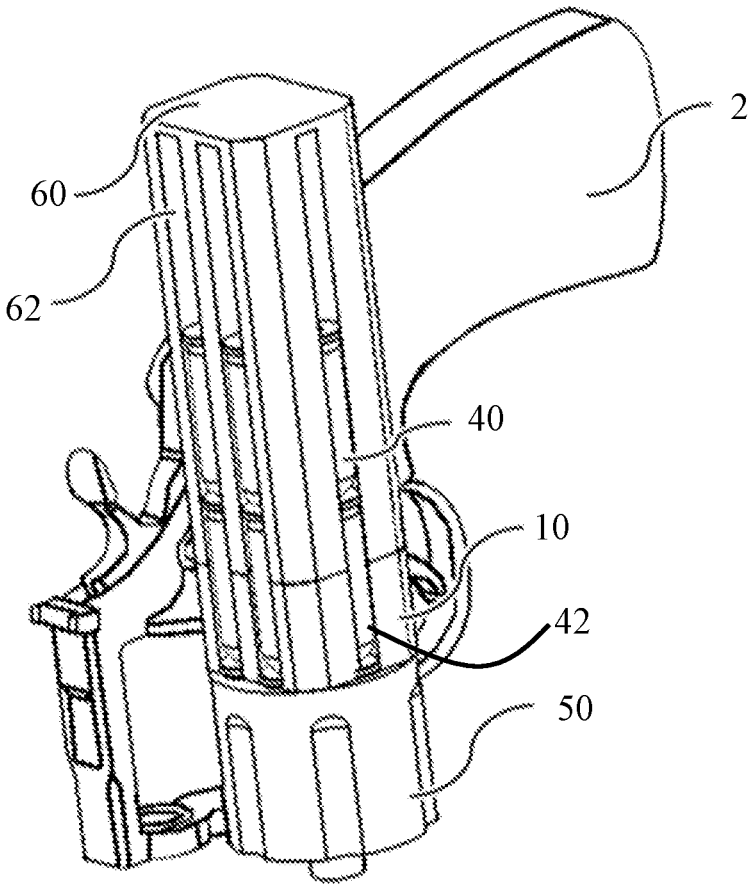
FIG. 1 shows a perspective view of a speed loader and a firearm in accordance with embodiments of the present disclosure.

FIG. 1 shows an embodiment of the speed loader 10 with an extender 60 loading cartridges 40 into a firearm 2. In the illustrated embodiment, the firearm 2 is a revolver and the cartridges are loaded a cylinder 50 of the firearm 2 (e.g., the revolver). It will be appreciated that in other embodiments, the firearm 2 may be any type of firearm including, for example, a rifle, a shotgun, or a pistol. The extender 60 includes passages 62 for the cartridges 40 and the passages 62 align with corresponding passages 42 of the speed loader 42. It will be appreciated that in some embodiments, the speed loader 10 does not include the extender 60.

Figure 2:
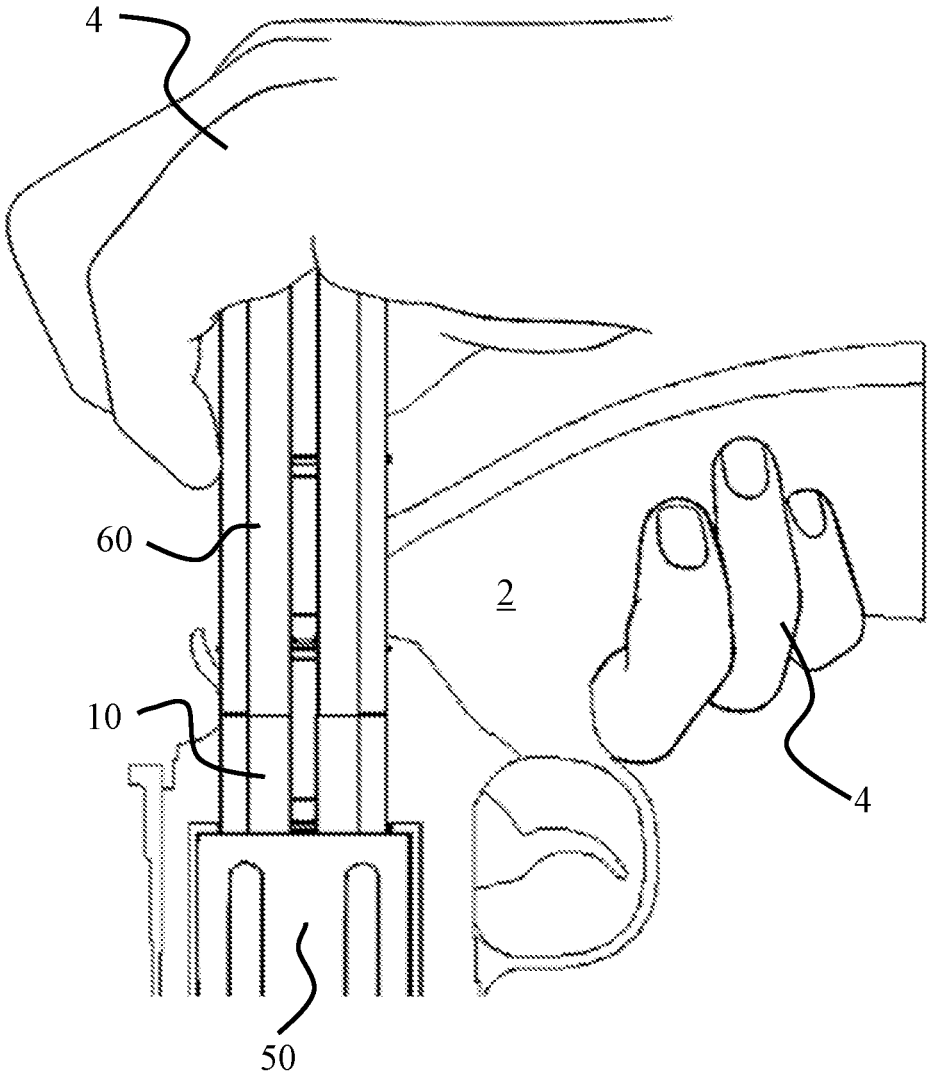
FIG. 2 shows a side view of a speed loader and a firearm in accordance with an embodiment of the present disclosure.

FIG. 2 shows the hand position for loading one embodiment of the speed loader 10. As illustrated, two hands 4 are shown with one hand 4 on the distal end of the extender 60 and one hand 4 on the handle of the firearm 2. The speed loader 10 is positioned on the cylinder 50 of the firearm 2. The extender 60 is connected to the speed loader 10. In various embodiments of the speed loader 10, the user may not need to hold the cylinder 50 stationary. Thus, the speed loader 10 may be used with one hand 4 while the other hand 4 holds the firearm 2.

Figure 3:
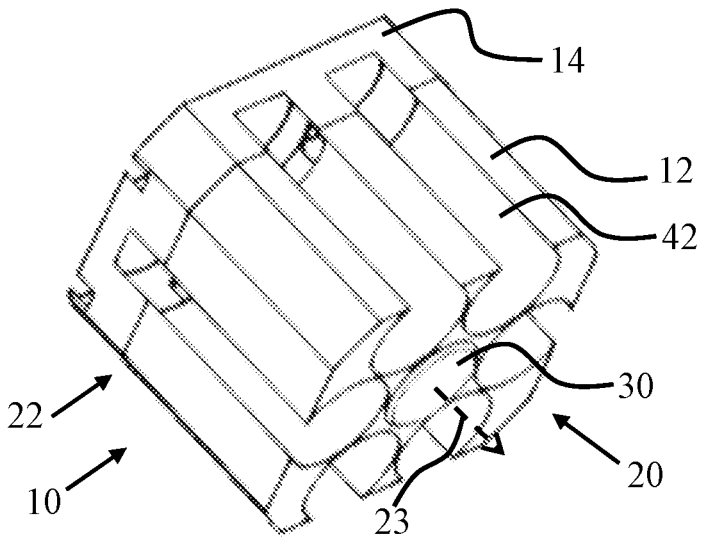
FIG. 3 is a perspective view of a speed loader in accordance with embodiments of the present disclosure.

FIG. 3 shows one embodiment of the speed loader 10 with a cover 14. In the illustrated embodiment, the speed loader 10 does not include the extender 60. The speed loader 10 has a main body 12 with the passages 42 for receiving cartridges and a button 30 on a first end 20 (e.g. a bottom end of the main body 12). The main body 12 includes a second end 22 opposite the first end 20 and proximate the cover 14.

Figure 4:
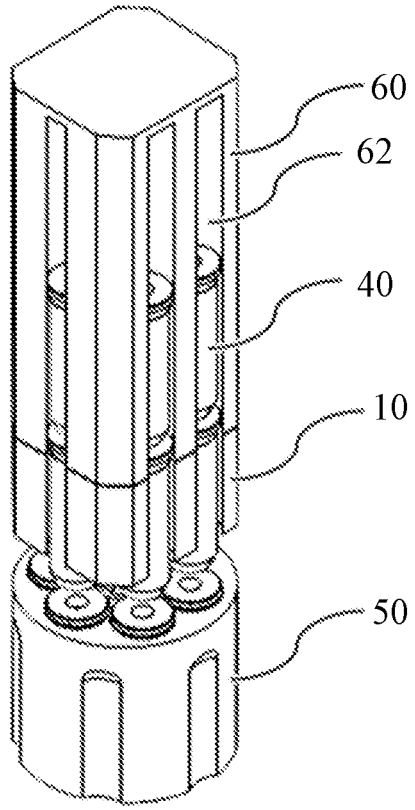
FIG. 4 is a perspective view of a speed loader and an extender in accordance with embodiments of the present disclosure.

FIG. 4 shows one embodiment of the speed loader 10 with the extender 60 after a round of cartridges 40 has been loaded into the cylinder 50. As shown, after a first round of cartridges 40 has been loaded, the remaining rounds of cartridges move towards the first end 20 of the main body 12 until a subsequent round of cartridges replaces the first round of cartridges 40.

Figure 5:
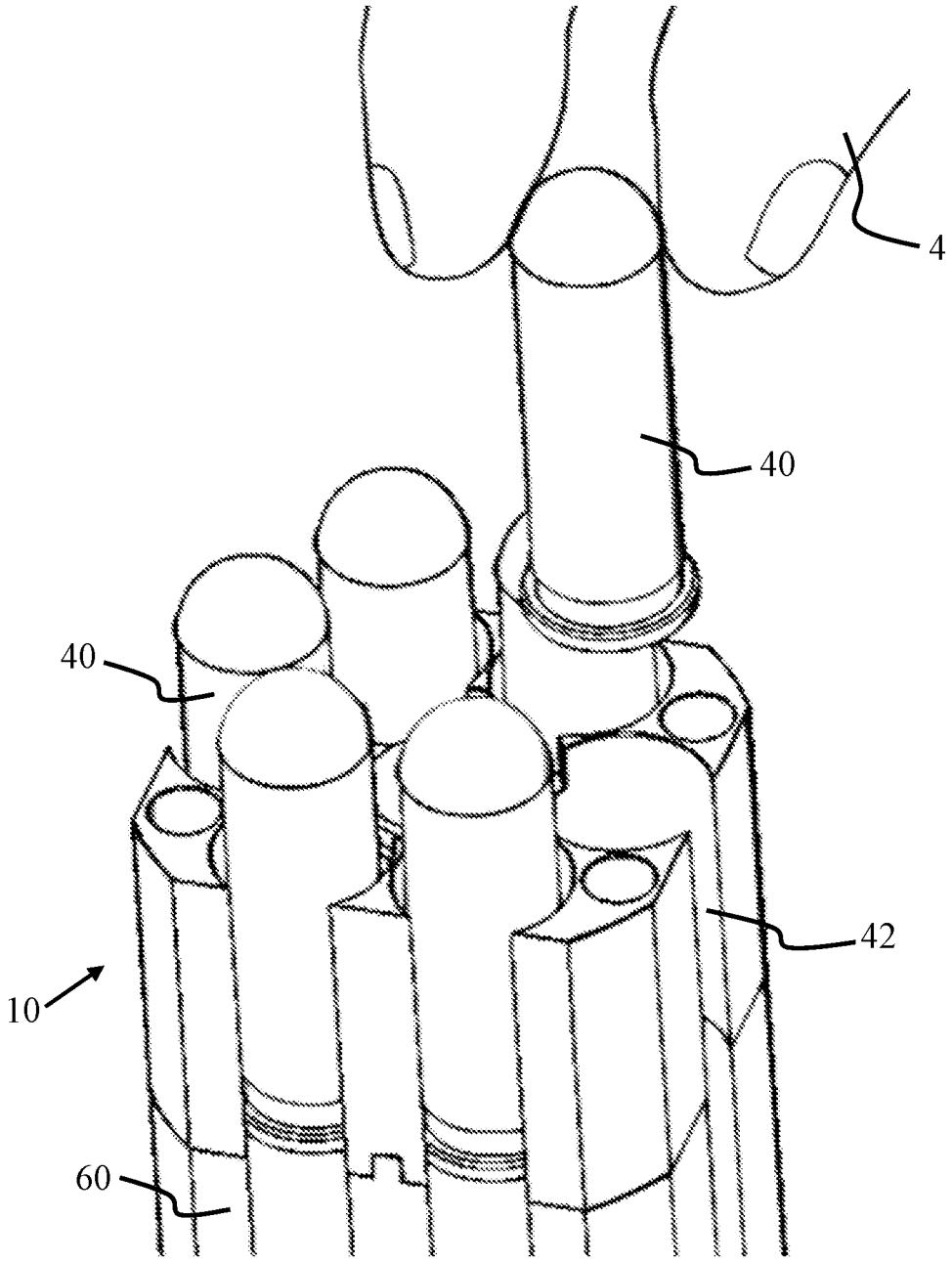
FIG. 5 is a detailed view of a speed loader in accordance with embodiments of the present disclosure.

FIG. 5 shows how cartridges 40 are loaded into one embodiment of the speed loader 10. In this embodiment, the cartridges are loaded into the bottom end or first end 20 of the speed loader 10.

Figure 6:
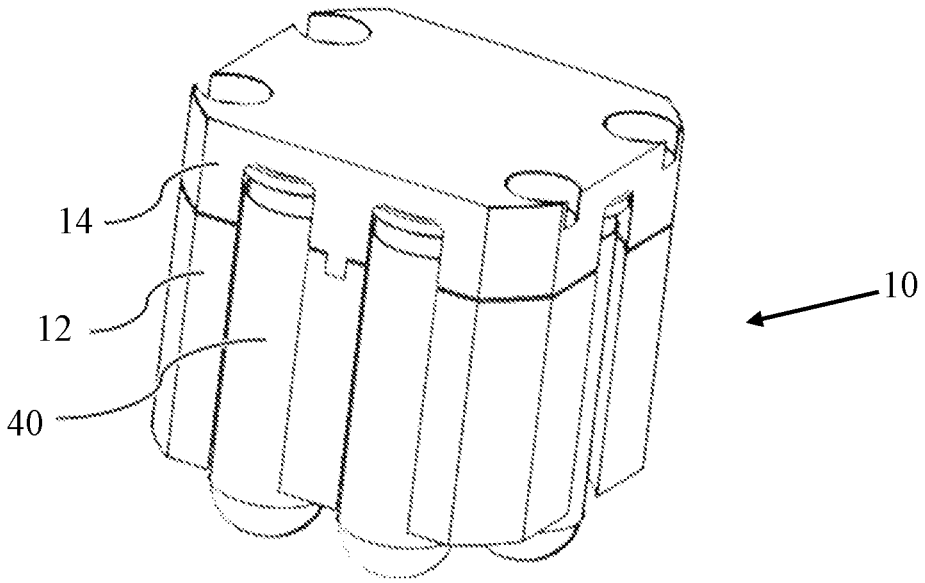
FIG. 6 is a perspective view of a speed loader in accordance with embodiments of the present disclosure.

FIG. 6 is a perspective view of one embodiment of the speed loader 10. The speed loader 10 includes the cover 14 to contain the cartridges within passages 42 in the main body 12 of the speed loader 10. The cover 14 may be used to store the round of cartridges 40 in the speed loader 10 and may prevent actuation of the speed loader 10.

Figure 7:
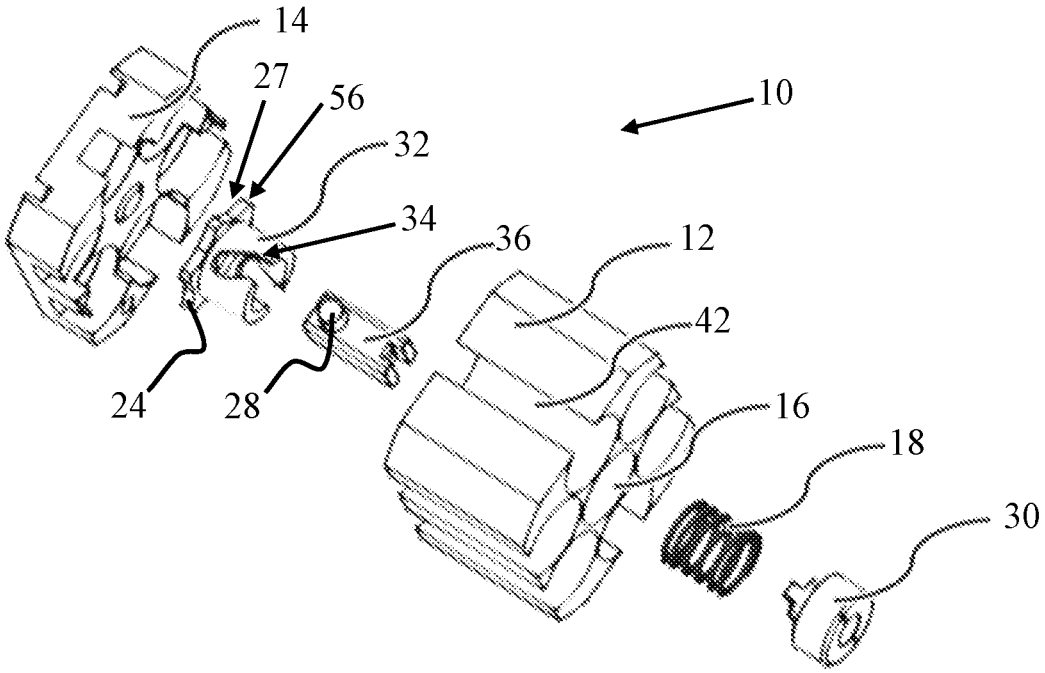
FIG. 7 is an exploded view of a speed loader in accordance with embodiments of the present disclosure.

FIG. 7 is an exploded view of an embodiment of the speed loader 10 with the cover 14 showing the components therein. The speed loader 10 has a main body 12 and cover 14. The main body 12 includes a plunger shaft spring cavity 16 wherein a plunger shaft 36 and a spring 18 are positioned. The plunger shaft 36 is interconnected on an end to the button 30. The plunger shaft 36 has a T portion 28 (also called a pin or protrusions herein) extending from one or two sides of the end opposite the button 30. The pin 28 fits into a corresponding one or more slots 34 in the disk cylinder 32. The pin 28 is movable between a first position at a first end of a corresponding slot 34 and a second position at a second end of the corresponding slot 34. The disk cylinder 32 is connected to a cartridge securing disk 24 (also called a disk or rotating disk herein).

Figure 8:
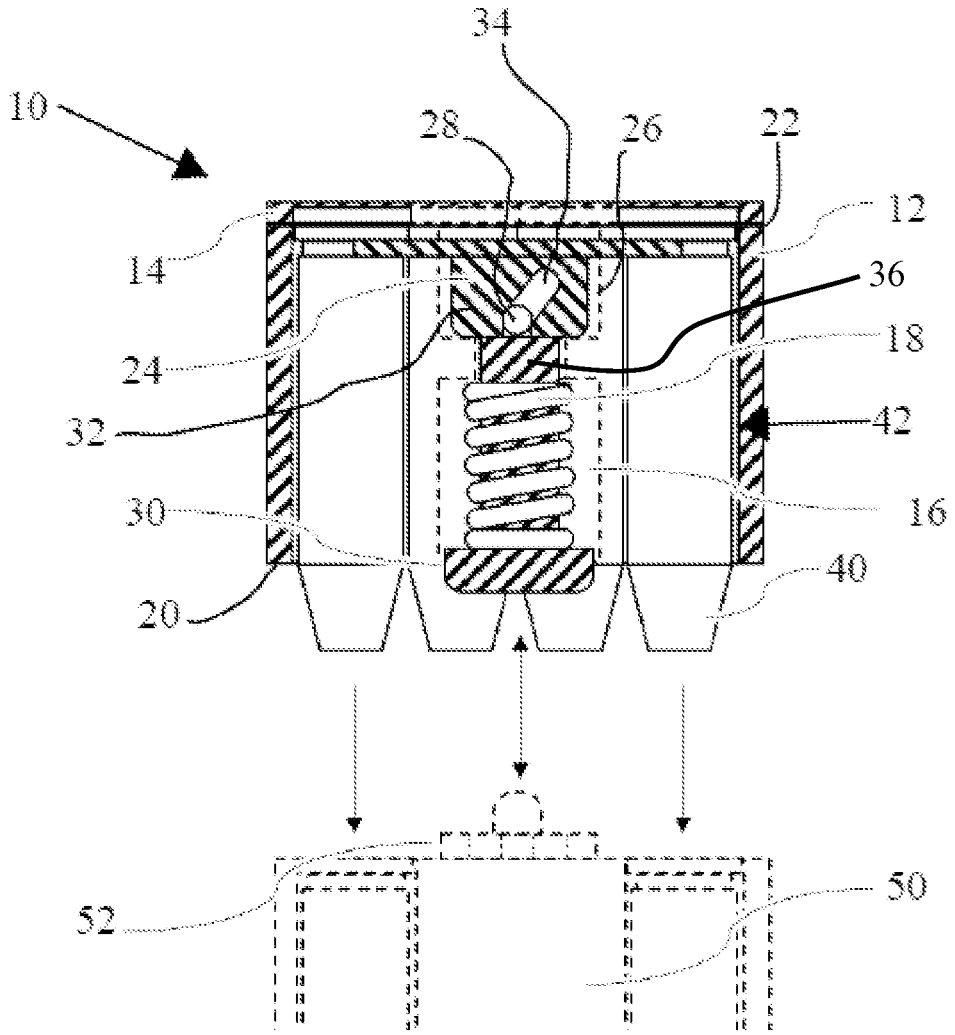
FIG. 8 is a cross-section side view of a speed loader in accordance with embodiments of the present disclosure.

Referring now to FIG. 8, the speed loader 10 comprises a main body 12 along a longitudinal axis 23 (visible in FIG. 3) between a first end 20 and a second end 22, the main body 12 first end 20 mating against a revolver cylinder ratchet 52 of the cylinder 50. The main body 12 second end 22 being longitudinally aligned and extending opposite from the main body 12 first end 20. The main body 12 includes the passages 42, which may extend axially along the longitudinal axis 23. The passages 42 may be radially distributed and adapted to align with and introduce the cartridges 40 into the passages 62 of the cylinder 50 of the firearm 2.

In embodiments where the speed loader 10 includes the cover 14, the cover 14 may be an interchangeable cartridge retaining cover 14 (also called a cover herein), located at the second end 22 of the main body 12. The cover 14 is configured to be attached to and removed from the main body 12.

In some embodiments the speed loader 10 comprises a plunger shaft spring cavity 16 that is aligned along the longitudinal axis 23 of the speed loader 10 and extends from the first end 20 of the main body 12 to contain the plunger shaft spring 18. The plunger shaft spring cavity 16 extends along the longitudinal axis 23 of the speed loader 10 between the first end 20 and the second end 22 of the main body 12 to guide the plunger shaft 36 along the longitudinal axis 23 between the first end 20 and second end 22 of the main body 12. One end of the plunger shaft 36 has a button 30 to activate the speed loader 10.

In some embodiments the speed loader 10 comprises the plunger shaft spring 18 that is arranged along a longitudinal axis 23 between a first end 20 and a second end 22 of the main body 12. The plunger shaft spring 18 has a first position where it exerts a force against the button 30 and, therefore, the plunger shaft 36 in the direction of first end 20 of the main body 12. The plunger shaft spring 18 exerts a greater force as the plunger shaft 36 moves along a longitudinal axis 23 in the direction of second end 22 of the main body 12, resulting in the second position (compressed position) of the plunger shaft spring 18. The plunger shaft spring's 18 loaded force is achieved through counter-exertion of the plunger shaft 36 spring against the main body 12 within the plunger shaft spring cavity 16. The plunger shaft spring's 18 loaded force is released through less exertion of the force between the plunger shaft 36 spring against the cylinder ratchet 52 and the main body 12.

The cartridge securing disk 24 is connected to a hollow cylinder 34 with a slot 34 to receive a T portion 28 (also called a pin or protrusions herein). The cartridge securing disk 24 is configured with a plurality of radially-extending portions or arms 56 (which may comprise, for example, arms 56, as described further below) that extend into and cover a portion of the cartridge passages 42. The radially-extending portions or arms 56 as illustrated extend from the disk 24 to cover at least the portion of the passages 42 to hold a cartridge in a corresponding passage 42. The radially-extending portions or arms 56 may actuate (e.g., rotate) between an engaged position (e.g., securing the cartridges 40 in the passages 42 preventing longitudinal movement) and a disengaged position (e.g., releasing the cartridges 40 from the being held in the passages 42 and allowing longitudinal movement). In some embodiments, the radially-extending portions or arms 56 may engage with the cartridges 40 at a point between the rim and the case of each cartridge 40. Some cartridges 40 may include a peripheral groove between the rim and the case of the cartridge 40 and the radially-extending portions or arms 56 may selectively engage with this groove. In any event, the cartridge securing disk 24 is connected to the plunger shaft 36 and is configured to receive the longitudinal force of the plunger shaft 36 and to transfer the longitudinal force to rotational force.

The plunger shaft 36 is centrally aligned along the longitudinal axis 23 between the first end 20 and the second end 22 of the main body 12. The plunger shaft 36 is movable along the longitudinal axis 23 between a first position and second position of the main body 12, wherein the first position is proximate to the first end 20 of the main body 12 and the second position is distal from the first position of the main body 12. One end of the plunger shaft 36 is positioned at the main body's 12 first end 20 where it contacts the revolver cylinder ratchet 52. The opposite end of the plunger shaft 36 is positioned proximate the second end of the main body 12 and transfers a longitudinal force, between the plunger shaft 36 and the revolver cylinder ratchet 52, to a rotational force. The disk cylinder 32 connects to the cartridge securing disk 24. The bar 28 of the plunger shaft 36 extends through the slots 34 to connect the plunger shaft to the disk cylinder 32.

In some embodiments, the cartridge 40 is a revolver cartridge. In other embodiments, the cartridge 40 may be a cartridge for any firearm. The ratchet 52 can be a typical revolver cylinder ratchet and is the contact point between the speed loader 10 and cylinder 50 in which force is applied between the speed loader 10 and cylinder 50 thus actuating the speed loader 10 to transfer the cartridge 40 into the cylinder 50, using gravitational or spring-loaded force. The cylinder 50 may be a revolver cylinder.

Figure 9:
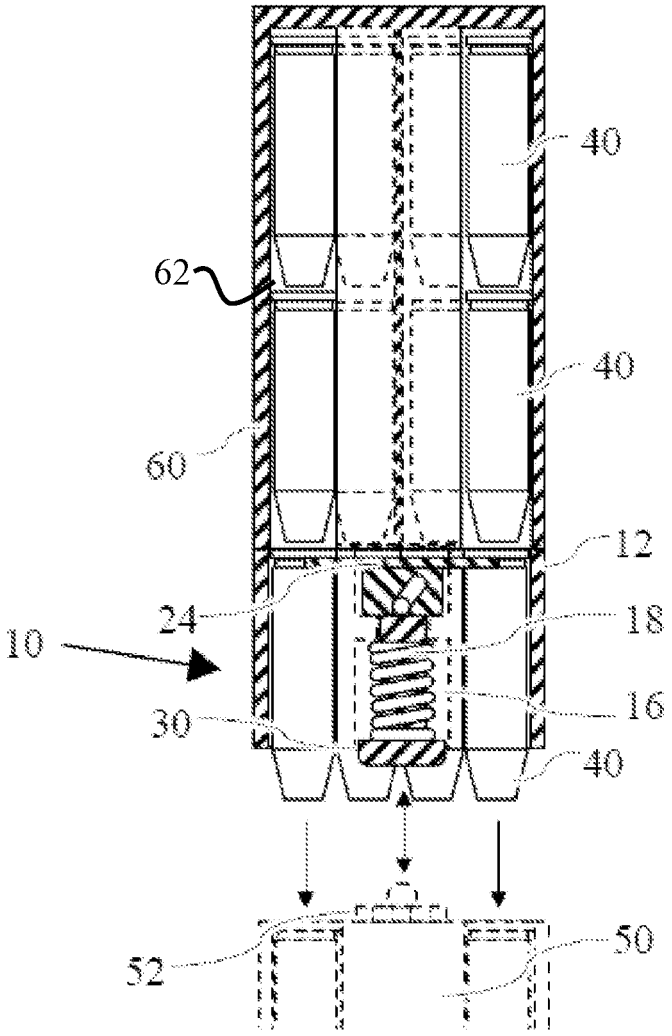
FIG. 9 is a cross-section side view of a speed loader and an extender in accordance with embodiments of the present disclosure.

Referring now to FIG. 9, the speed loader 10 is shown with the extender 60 (also called a speed loader extension). The main body 12 is configured to secure and release the speed loader extension 60 at the main body 12 second end 22. The speed loader extension 60 is located at the second end 22 of the main body 12 and replaces the cover 14. The speed loader extension 60 is configured to attach to and be removed from the main body 12. The speed loader extension 60 provides additional cartridge 40 capacity via a similar configuration of the main body's plurality of axially-extending, radially-distributed passages 42. The speed loader extension's passages 62 contain one or more cartridges 40 in a stacking, longitudinal arrangement.

Figure 10:
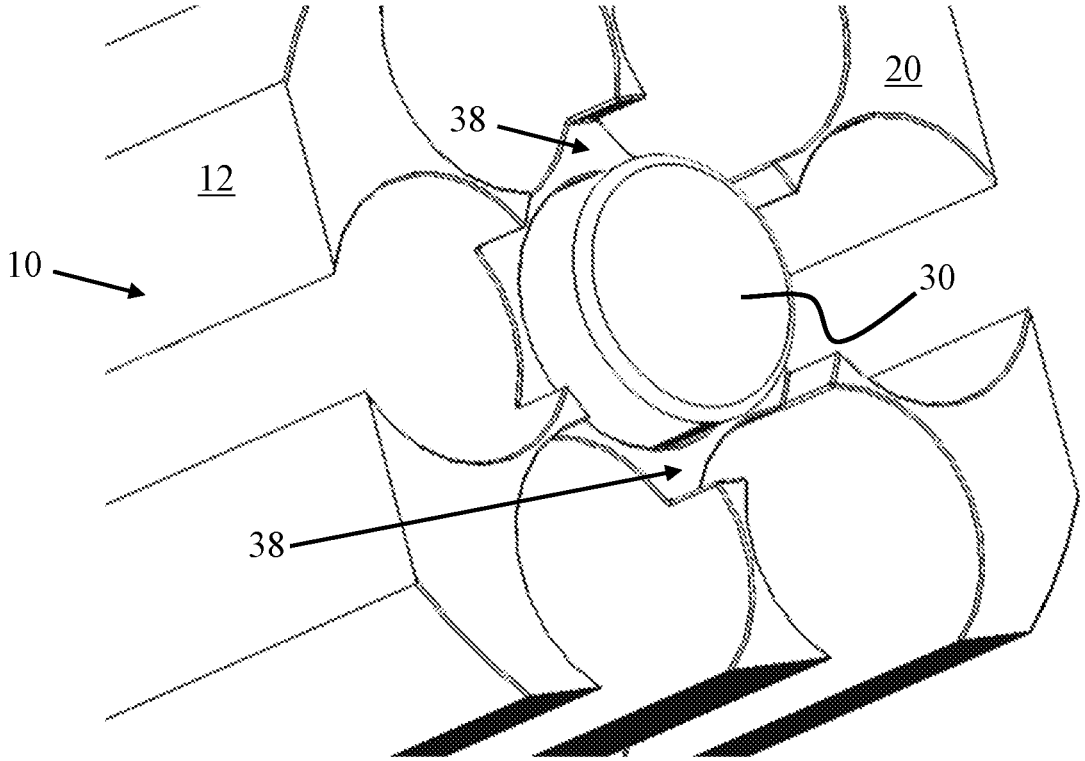
FIG. 10 is a perspective view of a speed loader in accordance with embodiments of the present disclosure.

FIG. 10 shows the speed loader 10 according to some embodiments where the first end 20 of the main body 12 has a ratchet cutout 38 around the button 30 to accommodate the ratchet on a revolver's cylinder. The ratchet cutout 38 has a sufficient diameter to allow non-knobbed ratchets to fit into the cutout 38 and thus allow the button 30 to be pressed for the button's full travel. The cutout 38 is designed to be deep enough to accommodate the ratchet during the entire cycle, i.e., the full distance the button 30 must travel to release the cartridges into the revolver cylinder. In some embodiments, the button 30 must travel 3.0 mm up and into the plunger shaft cavity 16 to rotate the locking mechanism into the unlocked or released position. As such, in the embodiment where the button 30 must travel 3.0 mm, the cutout 38 is about 3.25 mm to 4.0 mm deep. In a preferred embodiment, the ratchet cutout 38 is 3.5 mm deep. In other embodiments, the cutout 38 may be less than or greater than 3.5 mm deep. Additionally, the button 30 extends upwardly from the bottom of the cutout 38 at least about 3.0 mm. In some embodiments, the button 30 is positioned about 0.5 mm inward from the first end 20 outer surface. However, if the button 30 is taller than the cutout 38 is deep, then the button will extend outward beyond the outer surface of the first end 20 of the main body 12.

Figure 11:
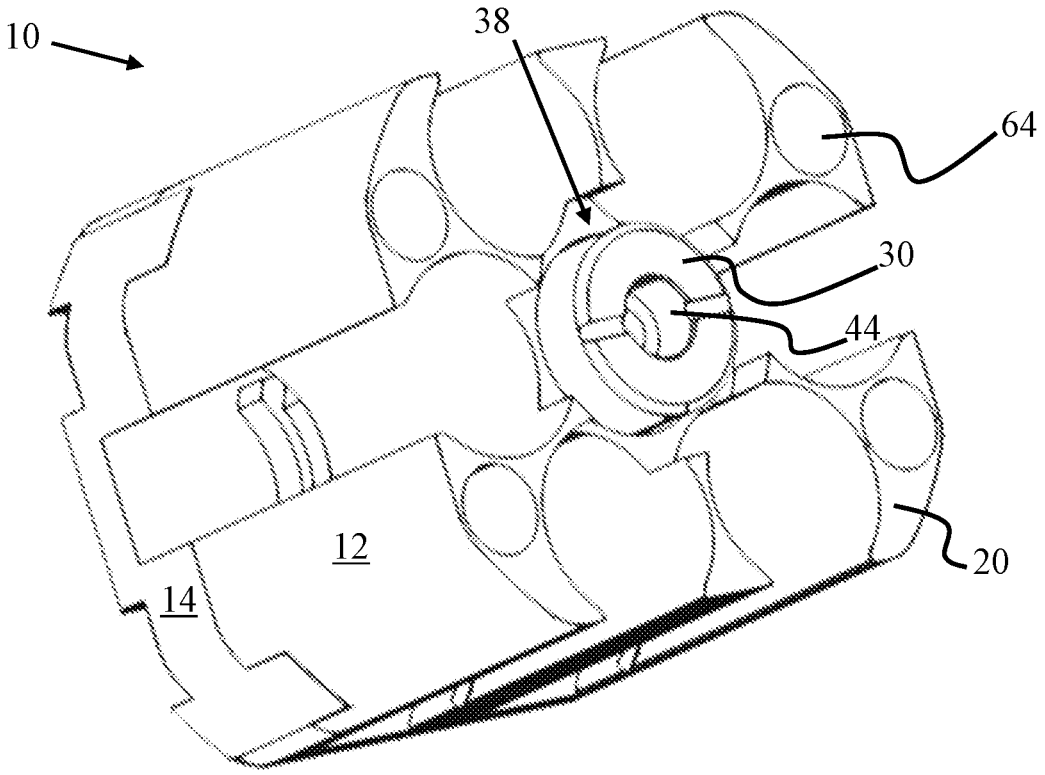
FIG. 11 is a perspective view of a speed loader in accordance with embodiments of the present disclosure.

FIG. 11 shows another embodiment of the speed loader 10. The speed loader 10 has apertures 64 in the bottom (outer surface) of the first end 20 of the main body 12. The apertures 64 can extend the entire length of the main body 12. In some embodiments, the apertures 64 are threaded to receive screws to secure the cover 14 or extender 60 (not shown in this figure) to the main body 12. The speed loader 10 has a ratchet cutout 38 around the button 30 to accommodate the ratchet on a revolver's cylinder, as similarly described with respect to FIG. 10. In the illustrated embodiment, the button 30 also has a button cavity 44 to accommodate a revolver cylinder ratchet that has a knob on top of the cylinder ratchet. The cutout 38 is designed to be deep enough to accommodate the ratchet during the entire cycle, i.e., the full distance the button 30 must travel to release the cartridges into the revolver cylinder. Additionally, the button cavity 44 must be deep enough to accommodate the ratchet knob during the entire cycle, i.e., the full distance the button 30 must travel to release the cartridges into the revolver cylinder. In some embodiments, the button 30 must travel 3.0 mm up and into the plunger shaft cavity 16 to rotate the locking mechanism into the unlocked or released position. As such, in the embodiment where the button 30 must travel 3.0 mm, the cutout 38 is about 3.25 mm to 4.0 mm deep. In a preferred embodiment, the ratchet cutout 38 is 3.5 mm deep. In other embodiments, the cutout 38 may be less than or greater than 3.5 mm deep. Additionally, the button 30 extends upwardly from the bottom of the cutout 38 at least about 3.0 mm. In some embodiments, the button 30 is positioned about 0.5 mm inward from the first end 20 outer surface. However, if the button 30 is taller than the cutout 38 is deep, then the button will extend outward beyond the outer surface of the first end 20 of the main body 12.

FIGS. 12-17 show one embodiment of the speed loader 10. Here the main body 12 has a circular cross-section, but it can also have a square-shaped cross-section or square-shaped with rounded or cut corners cross-section, as shown in FIGS. 10-11. In the embodiment shown, and in other embodiments discussed herein, the speed loader 10 has a star-shaped cartridge securing disk 24. The disk 24 may also be described as a star sprocket with the plurality of radially-extending portions or arms 56 as previously described. The disk 24 can have other shapes depending on the functionality and features of the speed loader.

Figure 12:
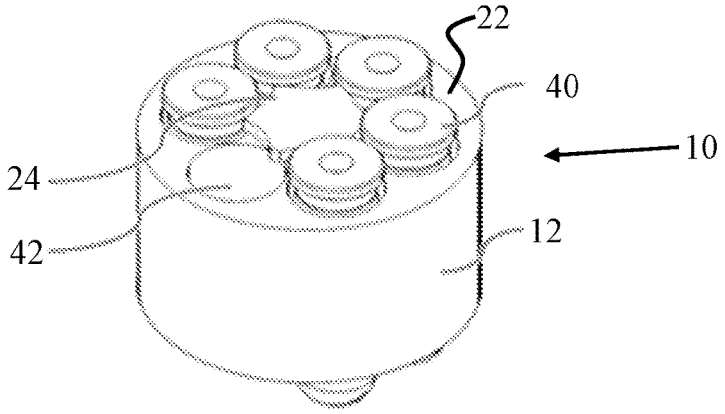
FIGS. 12-13 are perspective views of a speed loader in accordance with embodiments of the present disclosure.
Figure 13:
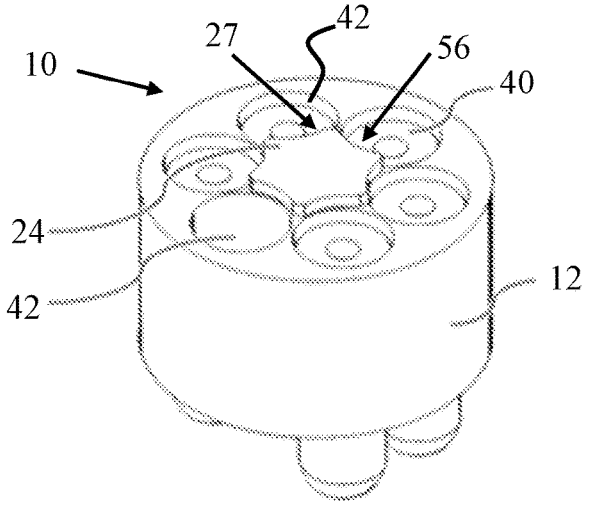

FIGS. 12-13 are perspective views of the speed loader 10 according to embodiments of the present disclosure. FIG. 12 shows the locking mechanism, here a cartridge securing disk 24, in the first position, also referred to as a locked position. The radially extending portions or arms 56 may be shaped as a point, arm, or lateral projection. Each point or arm or lateral projection of the star-shaped disk 24 is positioned under the cartridge flange of a cartridge 40 to lock the cartridges 40 in the speed loader passages 42 while also laterally supporting each cartridge 40 within its passage 42 such that the cartridge 40 is parallel with the passage 42 and the revolver cylinder's passages. The disk 24, and specifically the arms of the disk 24, prevent the cartridges 40 from falling out of the speed loader 10.

The disk 24 rotates to move the arms of the disk 24 away from the cartridges 40 such that the arms are positioned between the cartridge passages 42. This is the second position, also referred to as unlocked or released position and is shown in FIG. 13. The arms of the disk 24 are no longer positioned under the cartridges' flanges and the cartridges 40 can slide down and out of the speed loader 10 and into the cylinder 50.

Further, in embodiments where the speed loader 10 includes the extender 60, when in the first position of the cartridge securing disk 24 (e.g., shown in FIG. 12), the plurality of radially-extending portions or arms 56 retains the cartridges 40 within the main body's 12 passages 42

(e.g., by plurality of radially-extending portions or arms 56 engaging with the groove or space between the rim and the case of the cartridges 40, etc.) and prevents cartridges 40 held in the extender 60 from entering the main body 12. When the cartridge securing disk 24 is in the second position (e.g., shown in FIG. 13), the radially-extending portions do not cover the passages and rotate out of the groove or space between the rim and the case of the cartridges in the main body's passages 42), thereby allowing the cartridges 40 within the main body's 12 passages 42 to release (e.g., into the cylinder 50) and the cartridges 40 from the extender 60 to move in a direction parallel to the longitudinal axis 23 into the main body's 12 passages 42. More specifically, a space or recess 27 between two adjacent radially extending portions or arms 56 is sized to allow a cartridge 40 from the extender 60 to pass through the space or recess 27. As such, when the cartridge securing disk 24 is in the first position, primer ends of the cartridges 40 within the main body's 12 passages 42 (e.g., retained by the radially-extending portions or arms 56) prevent the cartridges 40 within the extender 60 from moving into a corresponding passage 42 and when the cartridge securing disk 24 is moved to the second position (by, for example, rotating) and the cartridges 40 within the main body's 12 passages 42 move out of the main body's 12 passages 42, the space or recess 27 is positioned in front of the next row of cartridges 40 within the extender 60, thereby allowing movement of the cartridges 40 from the extender 60, through the space or recess 27, and into the corresponding passage 42 in the main body 12. When released into a cylinder 50, the primer ends of the loaded cartridges 40 support the next row of cartridges 40 that have moved (e.g., from the extender 60) into the main body's 12 passages 42 at a dimension where the plurality of radially-extending portions or arms 56 align with the groove or space between the rim and the case of the next row of cartridges 40. In this case, when the speed loader 10 is moved from being engaged with the cylinder 50, the plurality of radially-extending portions or arms 56 automatically engage (e.g., by rotating under spring force, etc., back to the position of the cartridge securing disk 24 shown in FIG. 12) with the groove or space between the rim and the case of the next row of cartridges 40, now in the main body's 12 passages 42.

Figure 14:
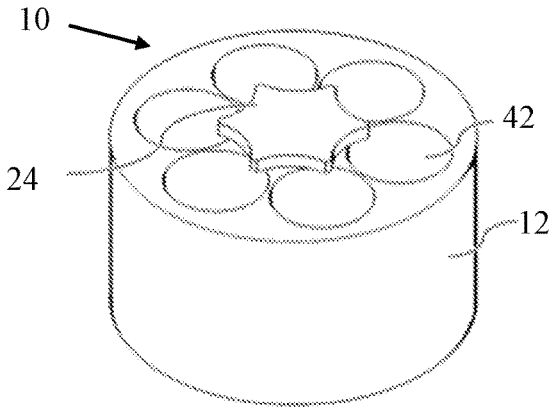
FIGS. 14-15 are perspective views of a speed loader without a cartridge in accordance with embodiments of the present disclosure.
Figure 15:
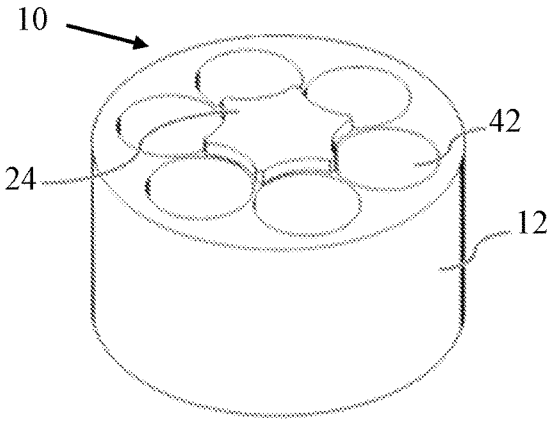

FIGS. 14 and 15 are the same as FIGS. 12 and 13, respectively, but show the speed loader 10 without cartridges. FIG. 14 shows the disk 24 in the locked or cartridge-engaged position and FIG. 15 shows the disk 24 in the unlocked or cartridge-released position.

Figure 16:
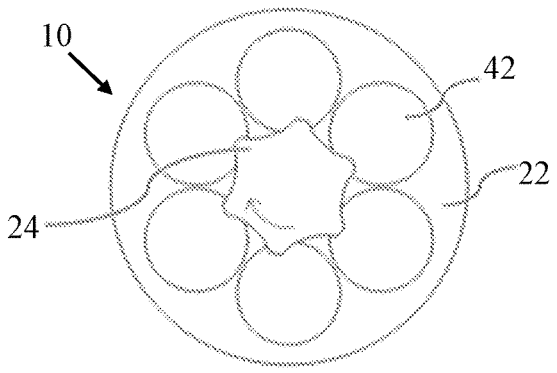
FIGS. 16-17 are top views of a speed loader in accordance with embodiments of the present disclosure.
Figure 17:
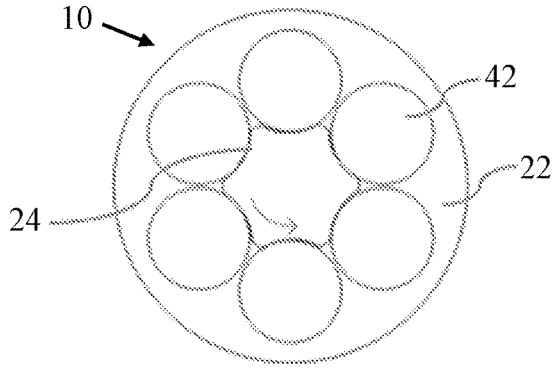

FIGS. 16 and 17 are top plan views of the speed loader 10 shown without cartridges. The top surface is the main body second end 22 upper or outer surface. FIG. 16 shows the disk 24 in the locked position and FIG. 17 shows the disk 24 in the unlocked or released position.

Figure 18:
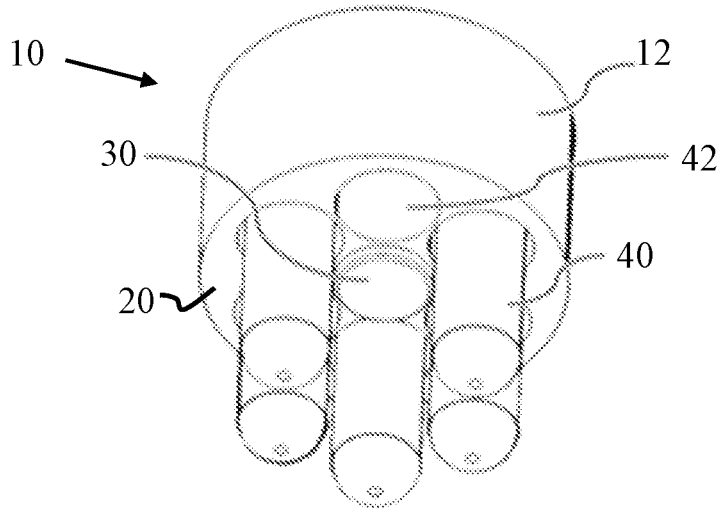
FIGS. 18-19 are bottom views of a speed loader in accordance with embodiments of the present disclosure.
Figure 19:
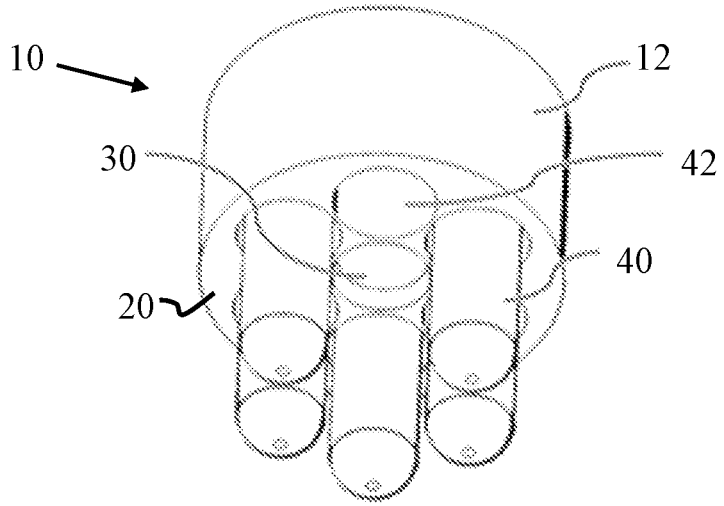

FIGS. 18 and 19 are bottom perspective views of the speed loader 10 according to some embodiments. The first end 20 of the main body 12 is visible in this view, along with the button 30 that releases the cartridges 40 by moving the locking mechanism from the locked position to the unlocked position. One cartridge passage 42 does not have a cartridge 40 for easy viewing of the button 30. In FIG. 18, the button 30 is extended and the locking mechanism is in the locked position holding the cartridges 40 in the speed loader 10. In FIG. 19, the button 30 is depressed and the locking mechanism is in the unlocked position such that the cartridges 40 will be released from the speed loader 10.

Figure 20:
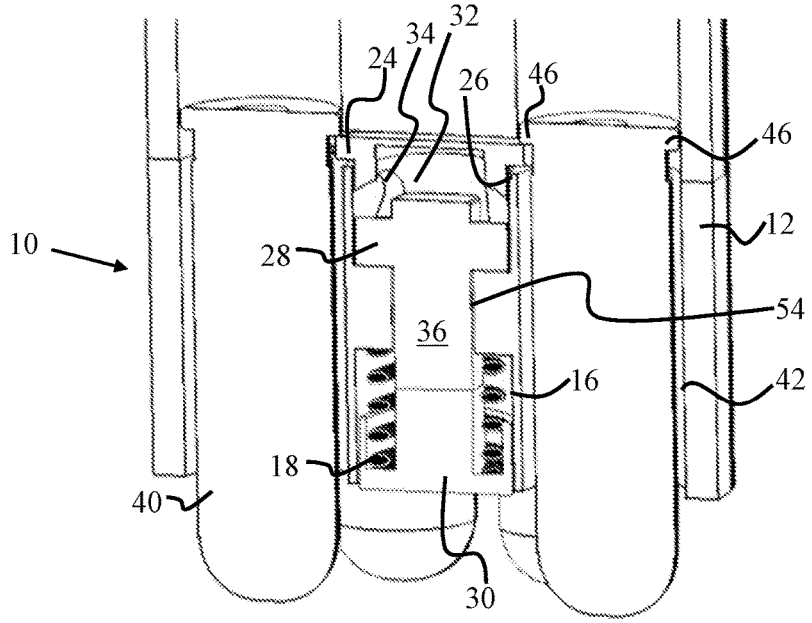
FIGS. 20-21 are cross-section views of a speed loader in a first position and a second position, respectively, in accordance with embodiments of the present disclosure.
Figure 21:
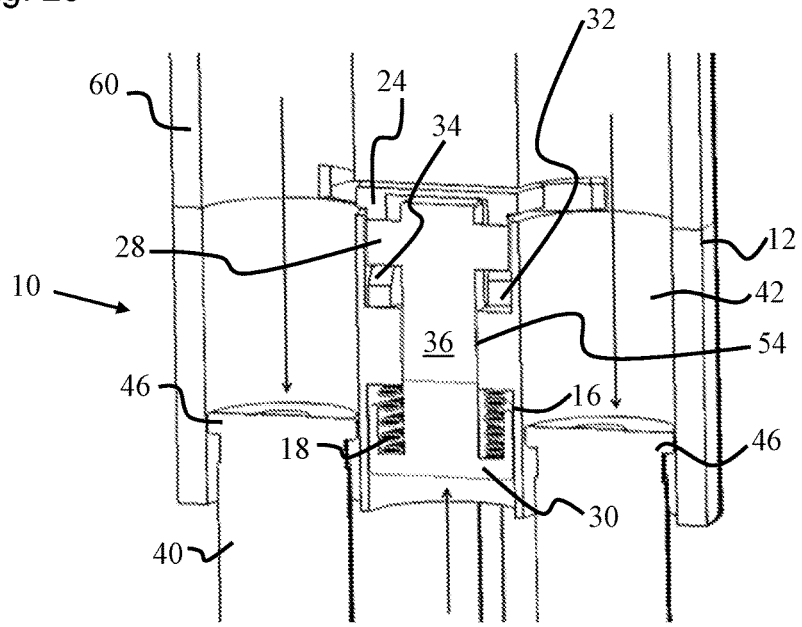

FIGS. 20 and 21 are sectional views of the speed loader 10 according to embodiments of the present disclosure. FIG. 20 shows the locking mechanism in the locked position. Here, the button 30 is down and the plunger shaft 36 is in its bottommost or lowermost position where the bottom of the pin 28 is resting on the bottom surface or shoulder of the cylinder cavity 26. The cylinder cavity 26 is connected to the plunger shaft spring cavity 16 via a narrow portion 54 of the plunger shaft cavity 16. A spring 18 surrounds the plunger shaft 36 and extends from the button 30 to the top of the plunger shaft spring cavity 16. The spring 18 is in a resting position but may be slightly compressed. The button 30 is attached to the plunger shaft 36. The pin 28 is positioned at the bottom of the slot 34 in the disk cylinder 32. This is the locked position because the arms of the disk 24 are positioned under the cartridges' flanges 46. Thus, the disk 24, and specifically the arms of the disk 24, prevent the cartridges 40 from sliding downward.

FIG. 21 shows the speed loader of FIG. 20 in the unlocked or released position. Here, the button 30 has been pressed and, thus, moved upward as shown by the upward pointing arrow below the button 30. As the button 30 is pressed upwardly, the spring 18 is compressed because the button 30 (the spring's lower boundary) has moved upward. Additionally, the disk cylinder 32 rotates, along with the disk 24 because the disk 24 is attached to the disk cylinder 32, due to the plunger shaft 36 and pin 28 attached thereto moving upward. The slot 34 is positioned at an angle such that the disk cylinder 32 rotates as the pin 28 moves in the slot 34. When the disk 24 and disk cylinder 32 rotate, the arms of the disk 24 move away from the cartridges' flanges 46 such that the arms are no longer positioned under the cartridges' flanges 46 and the cartridges 40 are free to fall down through the passages 42 and into the revolver cylinder, as represented by the downward arrows above the cartridges 40.

Once upward force is no longer exerted on the button 30, the force of the compressed spring 18 pushes the button 30 downward, which pulls the plunger shaft 36 downward since it is connected to the button 30, which rotates the disk cylinder 32 and the disk 24 attached thereto as the pin 28 rotates and moves down the slot 34. The speed loader 10 then returns to its locked position and the arms of the disk 24 catch the flanges 46 of the next set of cartridges 40 if an extender is used or cartridges can be loaded as shown in FIG. 5.

Note that in some embodiments, the plunger shaft cavity 16 may not have a narrow portion 54 such that the cylinder cavity 26 is the same diameter as and extends to the plunger shaft spring cavity 16. In which case, the upper boundary of the spring 18 would be the bottom of the disk cylinder 32.

The embodiments shown in FIGS. 20-35 are exemplary examples of only one method to turn longitudinal force into rotational force. Alternative embodiments are within the scope of the present disclosure, including the use of gears or a twisted spoon. Thus, the speed loader can be configured with one or more mechanisms known in the art to transfer longitudinal force from the plunger shaft and/or the revolver cylinder ratchet to rotational force to unlock a locking mechanism and release cartridges into the revolver cylinder.

Figure 22:
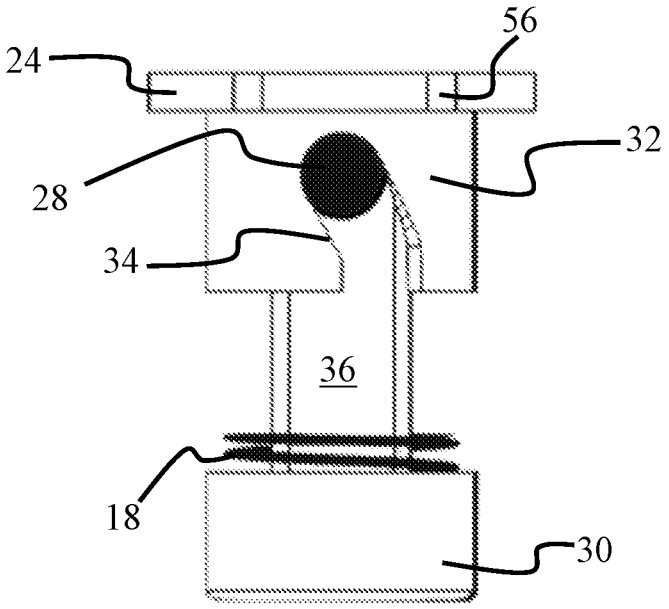
FIGS. 22-23 are side views of a speed loader in a first position and a second position, respectively, in accordance with embodiments of the present disclosure.
Figure 23:
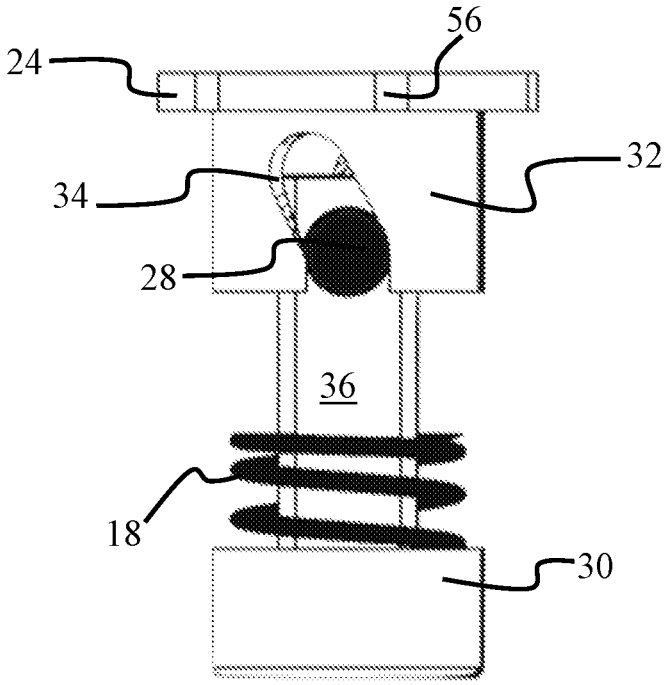

FIGS. 22 and 23 are side elevation views and show the locking mechanism in the locked and unlocked position. In FIG. 22, the pin 28 is positioned at the top of the slot 34 of the disk cylinder 32 such that the locking mechanism is in the unlocked position. The pin 28 is positioned between the radially-extending portions or arms 56 of the disk 24. The spring 18 encircles the plunger shaft 36 and extends upwardly from the inner surface of the button 30 to the top of the plunger shaft spring cavity (not shown). Accordingly, the spring 18 looks like it arbitrarily stops at an invisible upper boundary because the actual upper boundary is a part of the main body 12, which is not shown in these figures. Some of the spring 18 (lower portion) is not visible in FIGS. 22 and 23 because it is positioned within the button 30 because the button is hollow in some embodiments (see sectional views shown in FIGS. 20-21). However, in alternative embodiments the spring 18 may extend upward to the bottom surface of the disk cylinder 32, meaning that the bottom surface of the disk cylinder 32 is the upper boundary for the spring 18. In additional or alternative embodiments, the button 30 is not hollow and the spring's 18 lower boundary is the top surface of the button 30. In other words, the spring 18 does not extend down into the button 30 because the button 30 is solid and the shaft 36 connects to the top surface of the button 30, or if the button 30 is hollow then it has a flat upper surface connected to the shaft 36.

FIG. 23 shows the locking mechanism in the locked position because the pin 28 is positioned at the bottom of the slot 34 of the disk cylinder 32. The pin 28 is positioned below the radially-extending portion or arm 56 of the disk 34. Thus, the angle and lateral distance of the slot 34 must be long enough for the pin 28 to rotate the disk 24 the amount (i.e., arc length or degrees) from the radially-extending portion or arm 56 to a point between two radially-extending portions or arms 56 such that the radially-extending portions or arms 56 move out from the cartridge passages to release the cartridges. Again, the spring 18 extends upwardly from the button 30 more than is shown, but only a portion of the spring 18 is shown for clarity.

Figure 26:
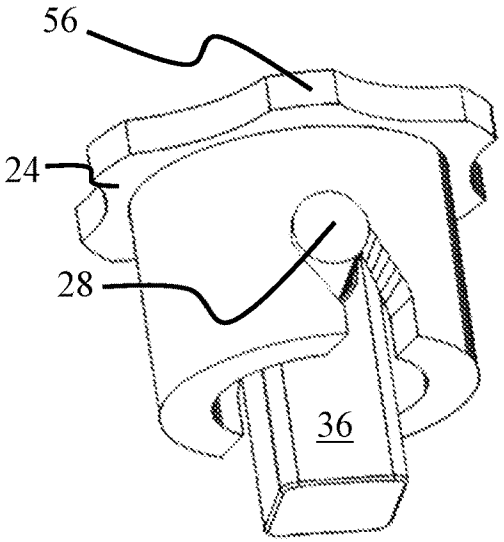
FIGS. 24-26 are side perspective views of a speed loader in a first position, a second position, and a third position, respectively, in accordance with embodiments of the present disclosure.
Figure 25:
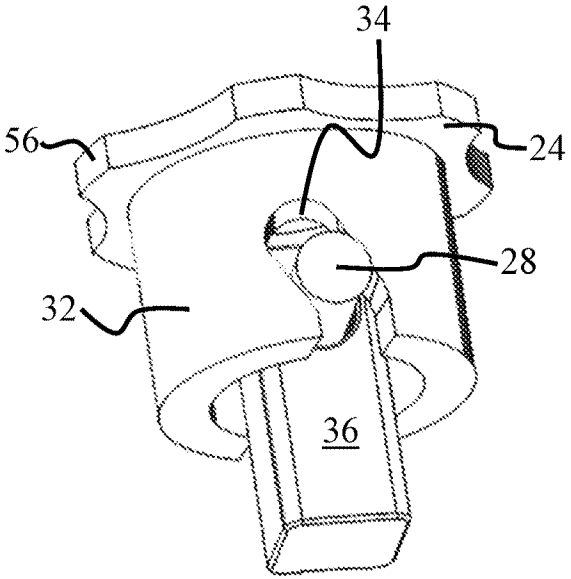
Figure 24:
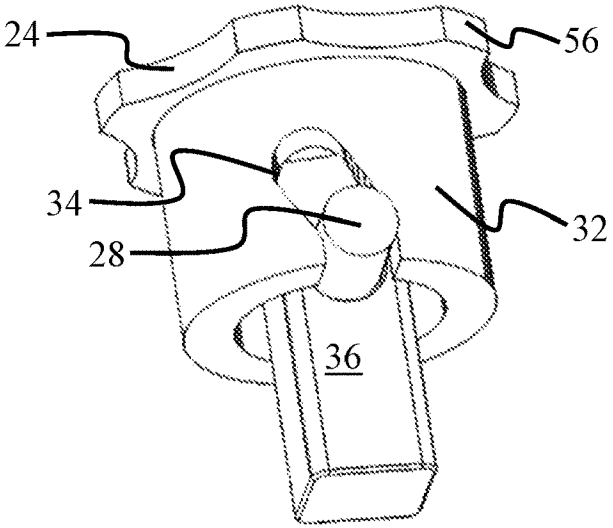

FIGS. 24-26 are side perspective views and show the locking mechanism as it rotates from the locked position (FIG. 24) to the unlocked position (FIG. 26). The pin 28 moves along the slot 34 to rotate the cylinder 32 and disk 24, which rotates the radially-extending portions or arms 56.

Note that in FIGS. 24-26 the angled slot 34 is aligned with the radially-extending portion or arm 56 and recess between the radially-extending portions or arms 56. In other words, the amount that the disk 24 rotates and the lateral (left to right in these figures) distance of the slot 34 depends on the distance from the radially-extending portion or arm 56 to the recess such that the locking mechanism can rotate from the locked position (i.e., when the pin 28 is at the bottom of the slot 34 and positioned below a recess between radially-extending portions or arms 56) to the unlocked position (i.e., when the pin 28 is at the top of the slot 34 and below a radially-extending portion or arm 56). However, the location of the pin 28 relative to the radially-extending portion or arm 56 could be the opposite depending on the disk 24 position in the speed loader, meaning that in the locked position the pin 28 may be positioned below a radially-extending portion or arm 56 and in the unlocked position the pin 28 may be positioned below a recess.

FIGS. 27-33 show the speed loader 10 with the extender 60 according to some embodiments of the present disclosure as the cartridges 40 are loaded into the cylinder 50 and the next set of cartridges 40 fall from the extender 60 and into the speed loader 10. Not all components are labeled in each of FIGS. 27-33 for clarity. However, it is understood that each of FIGS. 27-33 comprises the same components. FIGS. 27-33 show the device and locking mechanism at different stages of use.

Figure 27:
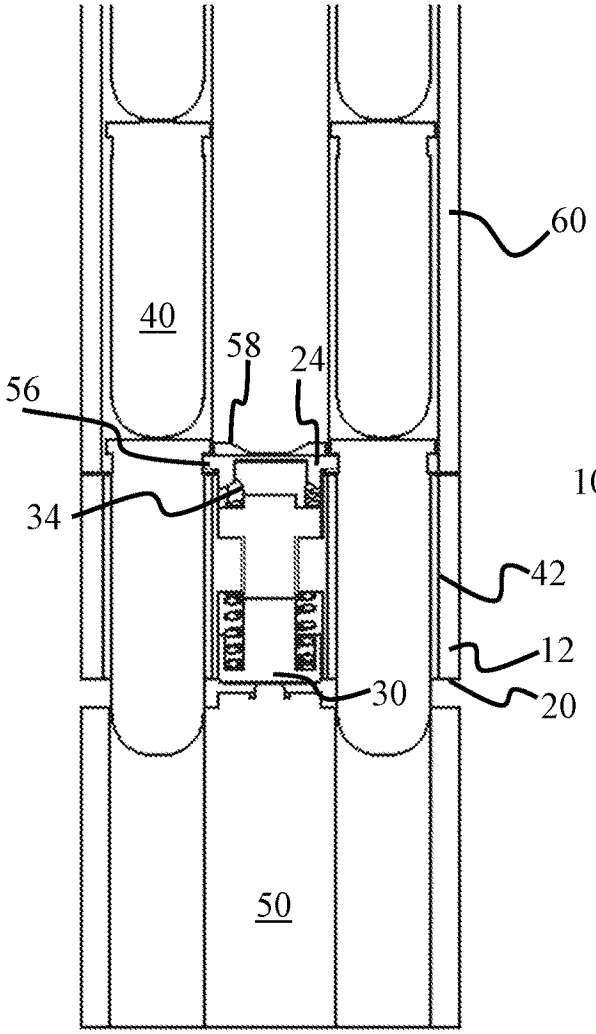

FIG. 27 shows the loading start position. The cartridges 40 in the speed loader 10 main body 12 are aligned with and partly inserted into the passages in the cylinder 50. The cylinder ratchet 52 is touching the speed loader button 30, but no force is applied to the button 30 yet. The main body 12 is shorter than the length of the cartridges 40 such that the cartridges 40 can be properly aligned into the cylinder 50. The spring 18 is slightly compressed or in a resting position. The bottom portion of the spring 18 contacts the inner surface of the button and the top portion of the spring 18 contacts the top of the plunger shaft spring cavity 16. The spring 18 is configured to hold the plunger shaft 36 and pin 28 in the downward, locked position. The pin 28 rests on the bottom of the cylinder cavity 26 to hold the plunger shaft 36 and button 30 in the speed loader 10 and prevent the plunger shaft 36 and button 30 from falling out of the speed loader 10. In this position, the disk 24 has 0 degrees of rotation and is at its starting position or locked position. The radially-extending portions or arms 56 of the disk 24 extend into the passages 42 of the speed loader 10 and passages 62 of the extender 60 such that the radially-extending portions or arms 56 are under the rim or flange 46 of each cartridges 40. Here, the speed loader first end 20 is approximately 3.0 mm above the top surface of the cylinder 50. It will be appreciated that in other embodiments, the first end 20 may be less than or greater than 3.0 mm above the top surface of the cylinder 50.

Figure 28:
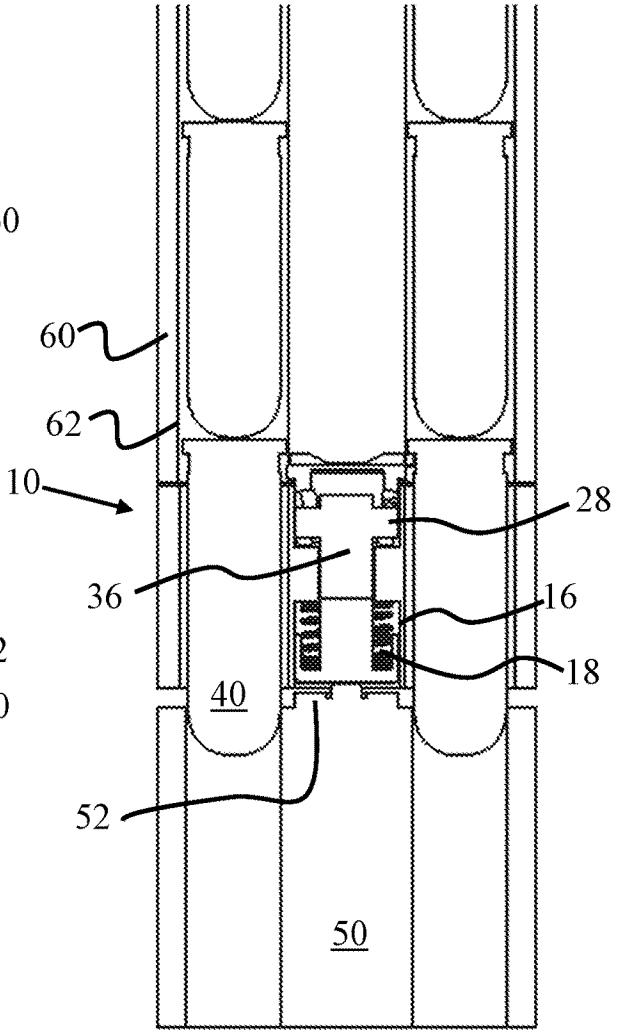

FIG. 28 shows the speed loader 10 approximately 1.0 mm closer to the top surface of the revolver's cylinder 50, i.e., the first end 20 of the speed loader 10 is approximately 2.0 mm above the top surface of the revolver's cylinder 50. It will be appreciated that in other embodiments, the first end 20 may be less than or greater than 2.0 mm above the top surface of the cylinder 50. The plunger shaft 36, pin 28, and button 30 are stationary relative to the cylinder 50. The spring 18 is under some compression and the pin 28 is no longer resting on the bottom of the cylinder cavity 26. The button 30 and shaft 36 have moved upward and into the speed loader 10 relative to the speed loader main body 12. The rotating disk 24 has currently has approximately 6.0 degrees of rotation. It will be appreciated that the rotating disk 24 may have less than or greater than 6.0 degrees of rotation. The radially-extending portions or arms 56 on the rotating disk 24 are still positioned such that they protrude into the speed loader's passages 42 and are still far enough into the passages 42 to remain under the rims 46 of the cartridges 40. The rotating disk 24 is in a cone-shaped cavity 58 of the extender 60. In the illustrated embodiment, the cavity 58 has a downward cone shape that contacts the rotating disk. The cone shape 58 reduces friction between the extender 60 and the rotating disk 28 as compared to a flat-roofed cavity. It will be appreciated that in other embodiments, the cavity 58 may have any other shape. The pin 28 is positioned in the groove or slot 34 of the disk cylinder 32 and rotates both the disk cylinder 32 and disk 24 as the pin 28 moves upward in the angled slot 34.

Figure 29:
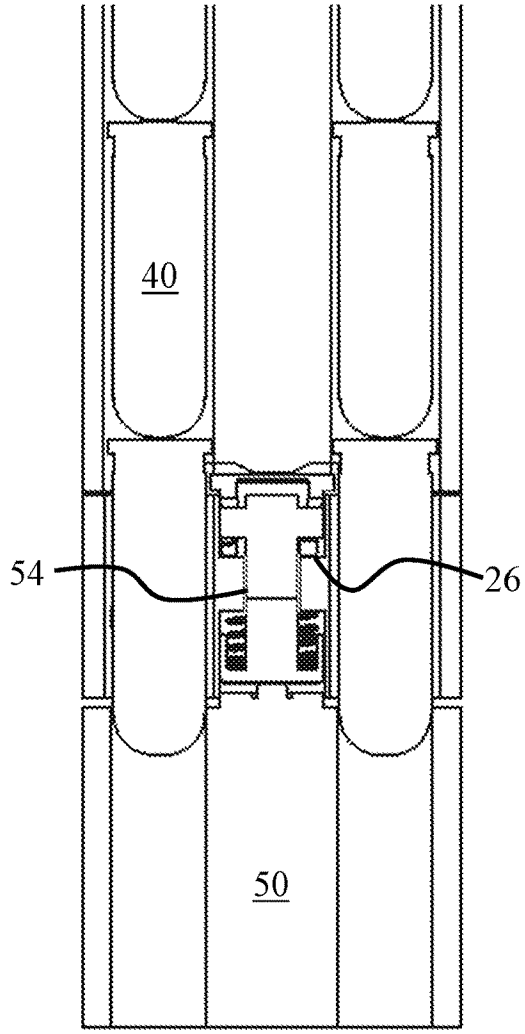
FIGS. 27-33 are cross-section views of a speed loader in a first position to a seventh position, respectively, in accordance with embodiments of the present disclosure.

FIG. 29 shows the speed loader 10 approximately 1.0 mm closer to the top surface of the revolver's cylinder 50 than FIG. 28, i.e., the first end 20 of the speed loader 10 is approximately 1.0 mm above the top surface of the cylinder 50. It will be appreciated that in other embodiments, the first end 20 may be less than or greater than 1.0 mm above the top surface of the cylinder 50. The plunger shaft 36, pin 28, and button 30 are stationary relative to the cylinder 50. The spring 18 is under more compression. The button 30 and shaft 36 have moved upward and into the speed loader 10 relative to the speed loader main body 12. The rotating disk 24 has rotated approximately 12 degrees and the radially-extending portions or arms 56 of the disk 24 are still positioned in the passages 42 such that they are under the flanges 46 of the cartridges 40. It will be appreciated that the rotating disk 24 may have less than or greater than 12 degrees of rotation.

Figure 30:
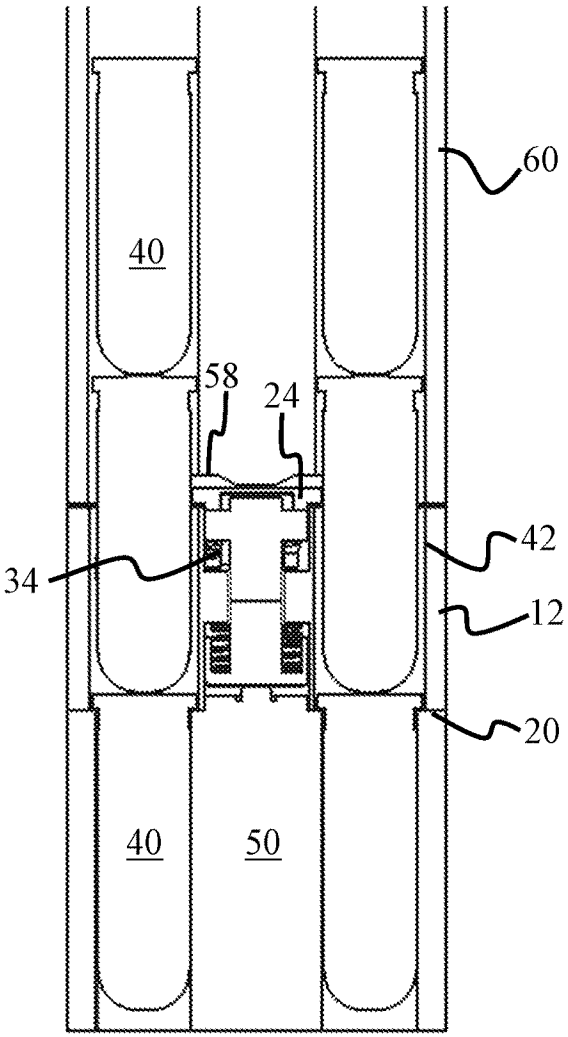

FIG. 30 shows the point at which the cartridges 40 are released and drop into the revolver's cylinder 50. The button 30 is fully compressed and the first end 20 of the main body 12 is touching the top of the revolver's cylinder 50. In this embodiment, the speed loader 10 travels about 3.0 mm to release the cartridges 40. The button 30, shaft 36, and pin 28 have remained stationary relative to the revolver's cylinder 50. The spring 18 is under compression and in its compressed state. The button 30 and shaft 36 have moved upward and into the speed loader 10 relative to the speed loader main body 12. The rotating disk 24 has rotated approximately 18 degrees and the radially-extending portions or arms 56 of the disk 24 are no longer in the passages 42. It will be appreciated that the rotating disk 24 may have less than or greater than 18 degrees of rotation. Thus, the radially-extending portions or arms 56 are no longer under the flanges 46 of the cartridges 40 and gravity causes the cartridges 40 to fall into the cylinder 50. The cartridges 40 in the extender 60 are also falling downward due to gravity, such that the bottom row will eventually fill the speed loader 10. Although the embodiments discussed here use a 3.0 mm travel distance for the button 30 and 18 degrees of rotation, other distances and degrees of rotation can be used in various embodiments.

Figure 31:
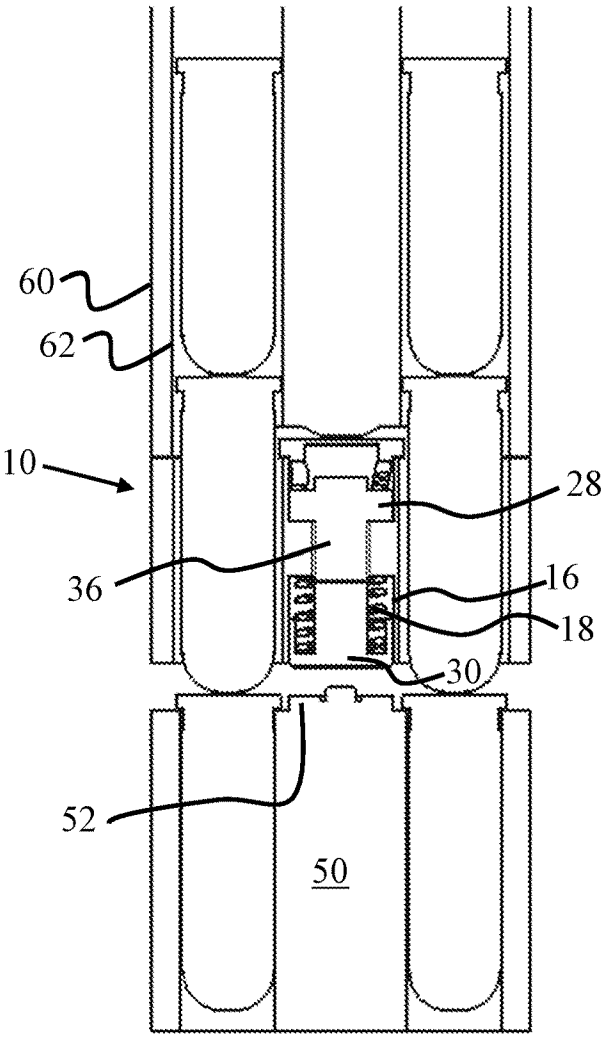

FIG. 31 shows the speed loader 10 being pulled away from the revolver and the components have returned to their start position. The spring 18 pushes the button 30 and shaft 36 downward and the pin 28 is resting on the bottom of the cylinder cavity. The disk 24 is rotating back to its start position of 0 degrees and the radially-extending portions or arms 56 of the disk 24 are extending into the passages 42. The radially-extending portions or arms 56 are sliding along the cartridges' casings until they reach the cartridges' flanges 46.

Figure 32:
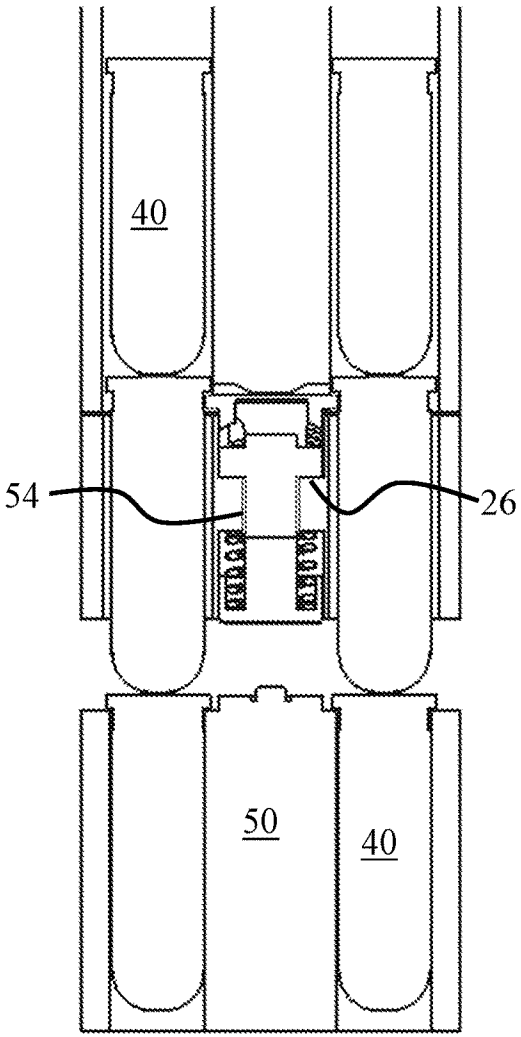

FIG. 32 shows the components in the start (locked) position and the radially-extending portions or arms 56 of the disk 24 are caught under the flanges 46 of the cartridges 40 and the cartridges 40 are held in place by the radially-extending portions or arms 56. Gravity causes the cartridges 40 to slide down through the extender 60 passages 62 until the flanges 46 of the cartridges 40 reach the radially-extending portions or arms 56. The spring 18 is constantly pushing on the button 30 and thus pulling the shaft 36 downward such that the disk 24 wants to return to its resting or locked position where the radially-extending portions or arms 56 are extending into the cartridge passages 42.

Figure 33:
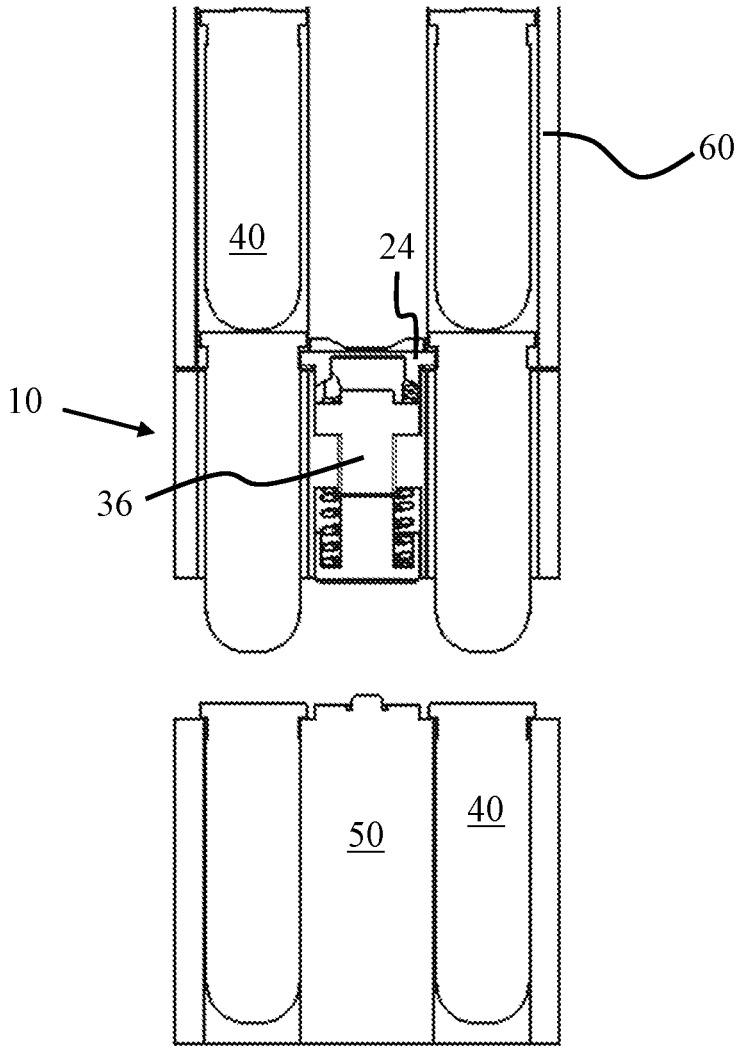

FIG. 33 shows the speed loader 10 and the extender 60 as they are pulled farther away from the cylinder 50.

Figure 34:
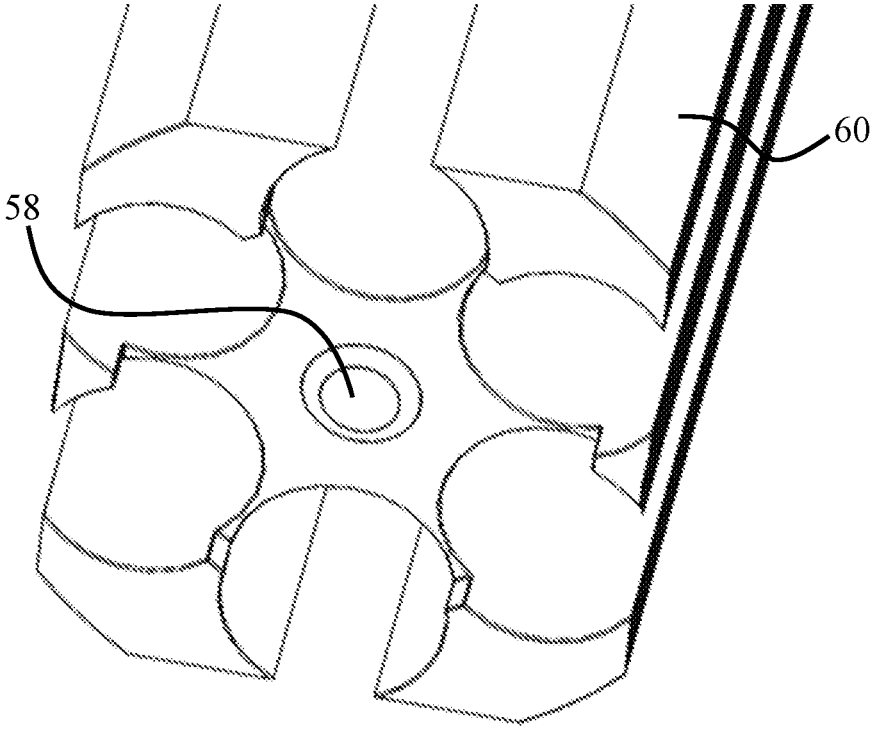
FIG. 34 is a detailed view of an extender in accordance with embodiments of the present disclosure.

FIG. 34 shows the cone-shaped cavity 58 in the bottom surface of the extender 60.

Figure 35:
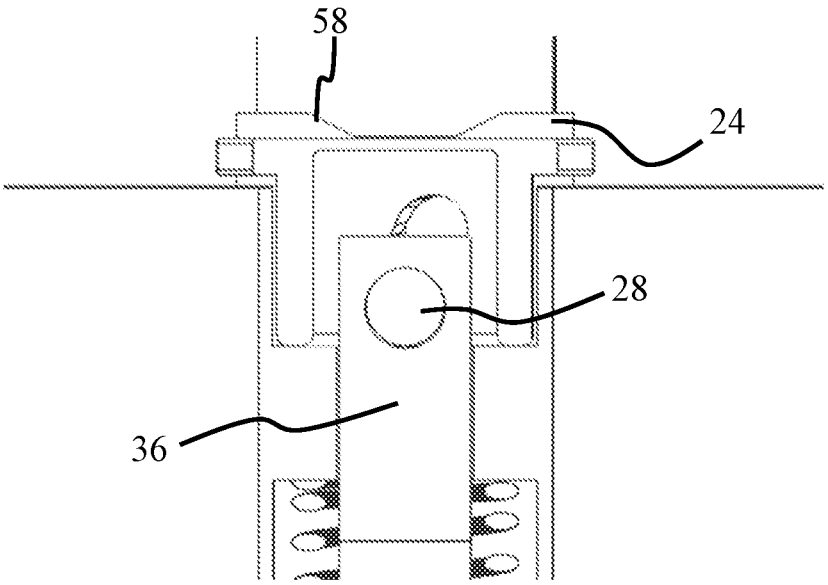
FIG. 35 is a detailed cross-section view of a speed loader in accordance with embodiments of the present disclosure.

FIG. 35 shows the cone-shaped cavity 58 positioned above the disk 24 of the speed loader.

Figure 36:
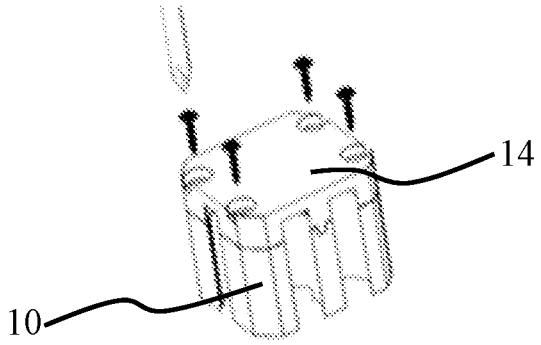
FIG. 36 is a perspective view of a cover in accordance with embodiments of the present disclosure.
Figure 37:
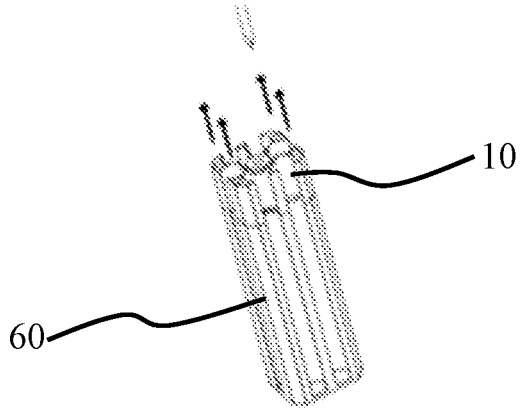
FIG. 37 is a perspective view of an extender in accordance with embodiments of the present disclosure.

FIGS. 36 and 37 show how the cover 14 and extender 60 are attached and detached from the speed loader 10 using screws.

Figure 38:
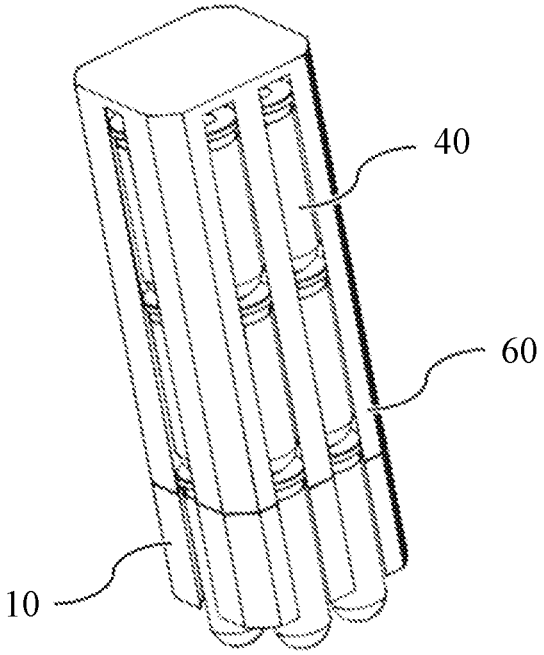
FIG. 38 is a perspective view of a speed loader and an extender in accordance with embodiments of the present disclosure.
Figure 39:
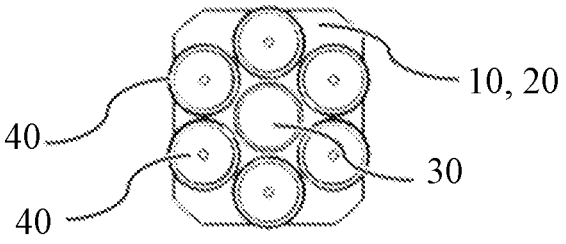
FIG. 39 is a bottom view of a speed loader in accordance with embodiments of the present disclosure.
Figure 40:
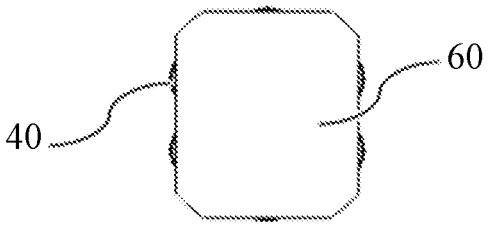
FIG. 40 is a top view of an extender in accordance with embodiments of the present disclosure.
Figure 41:
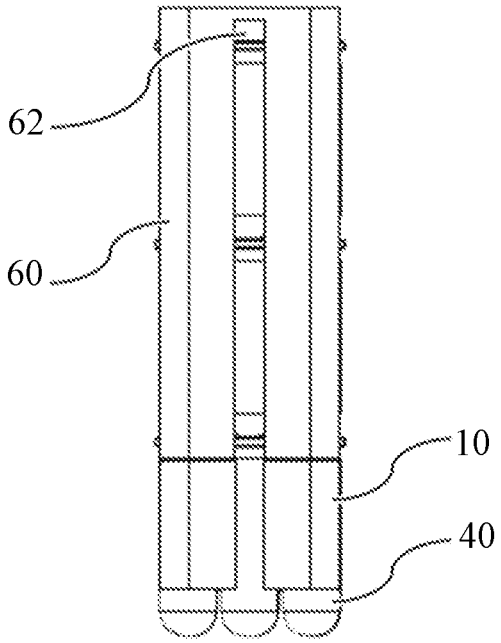
FIG. 41 is a side view of a speed loader and an extender in accordance with embodiments of the present disclosure.
Figure 42:
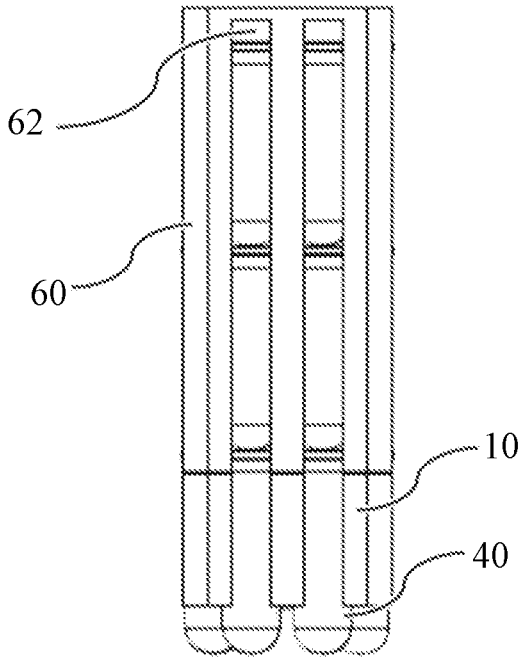
FIG. 42 is a side view of a speed loader and an extender in accordance with embodiments of the present disclosure.

FIG. 38 is a side perspective view of one embodiment of the speed loader 10 with the extender 60 and cartridges 40. FIG. 39 is a bottom plan view showing the first end 20 of the speed loader 10, button 30, and cartridges 40. FIG. 40 is a top plan view showing the top of the extender 60 and cartridges 40. FIG. 41 is a side elevation view and FIG. 42 is another side elevation view of the speed loader 10 with extender 60 according to some embodiments.

Figure 43:
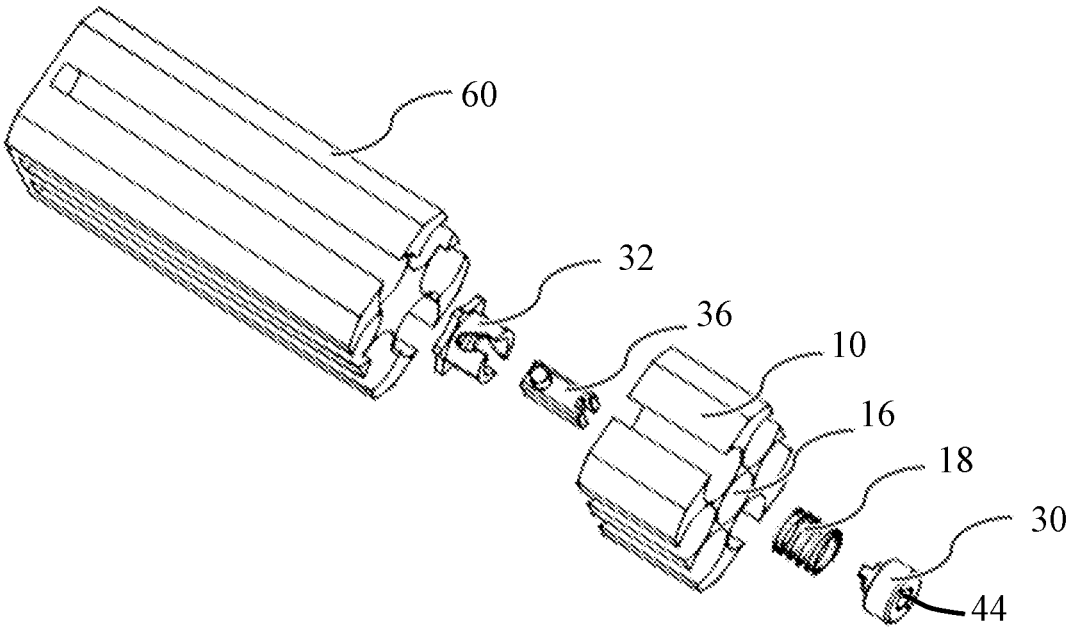
FIG. 43 is an exploded view of a speed loader and an extender in accordance with embodiments of the present disclosure.

FIG. 43 is an exploded view of the speed loader 10 with the extender 60 according to embodiments of the present disclosure. The button 30 has a cavity 44 to accommodate cylinder ratchets with knobs.

Figure 44:
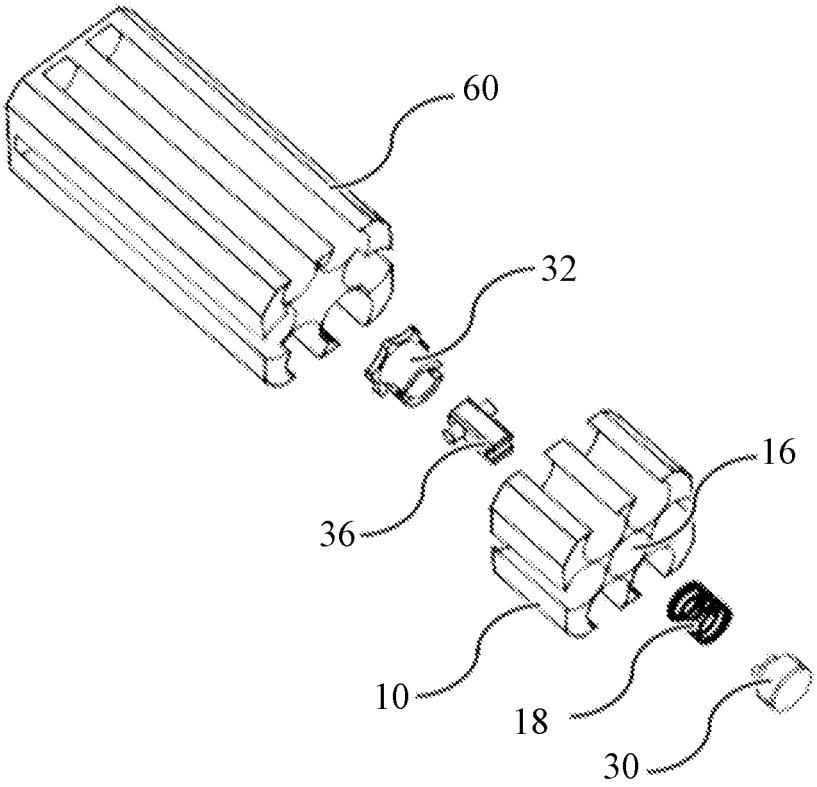
FIG. 44 is an exploded view of a speed loader and an extender in accordance with embodiments of the present disclosure.
Figure 45:
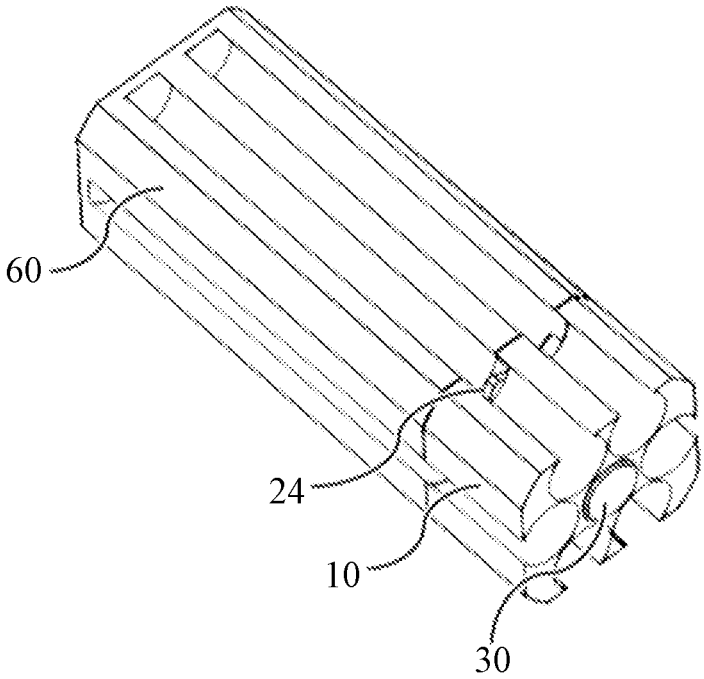
FIG. 45 is a perspective view of a speed loader and an extender in accordance with embodiments of the present disclosure.

FIG. 44 is an exploded view of the speed loader 10 with an extender 60 according to embodiments of the present disclosure. The button 30 does not have a cavity. FIG. 45 is the assembled perspective view of the speed loader 10 and extender 60 of FIG. 44.

Figure 48:
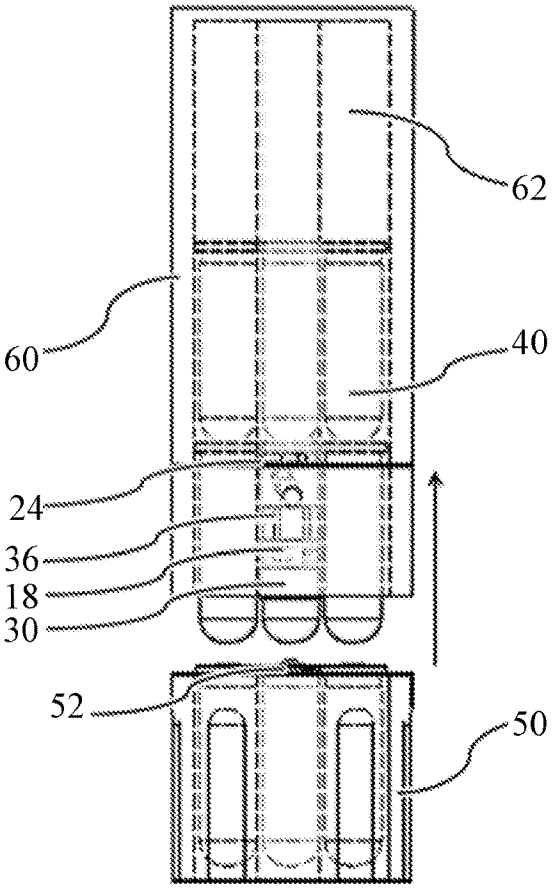
FIGS. 46-48 are side views of a speed loader and an extender in a first position, a second position, and a third position, respectively in accordance with embodiments of the present disclosure.
Figure 47:
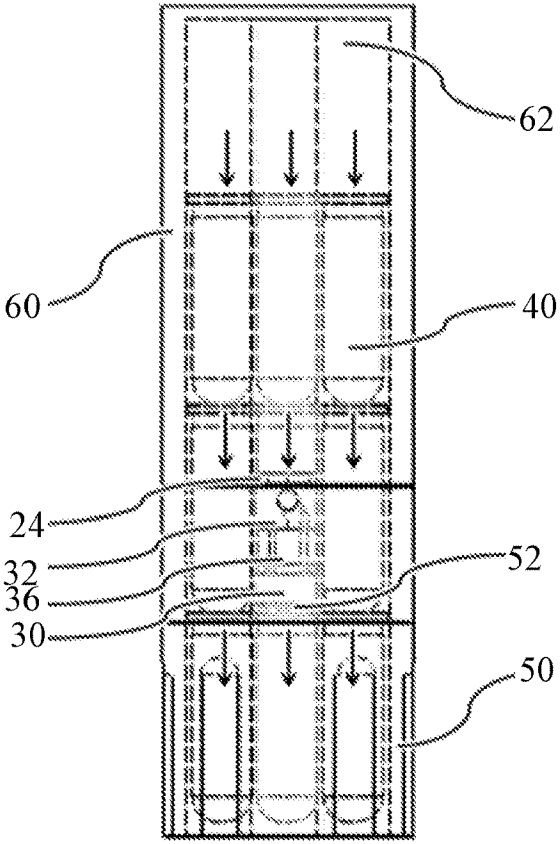
Figure 46:
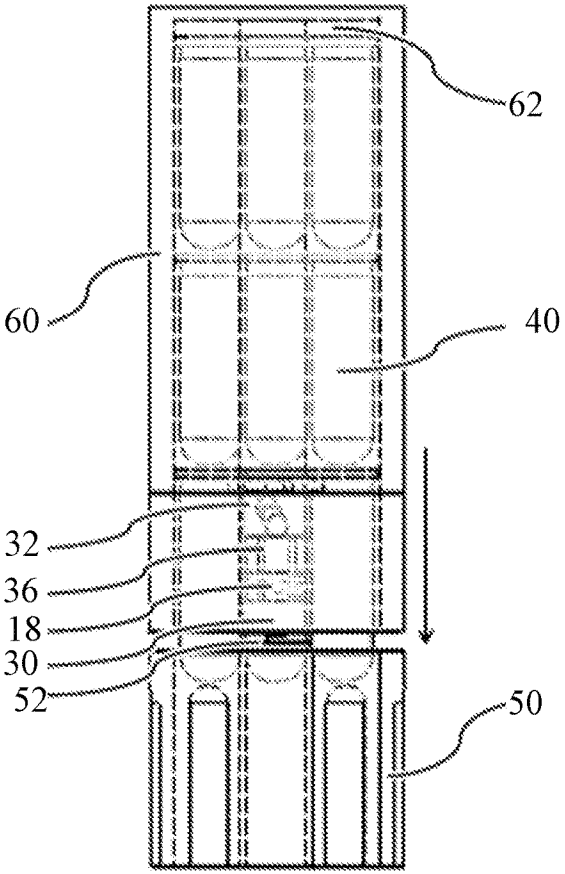

FIGS. 46-48 are side views of the speed loader 10 and the extender 60 according to embodiments of the present disclosure and show a series of steps as the cartridges 40 are loaded into the cylinder 50.

Figure 49:
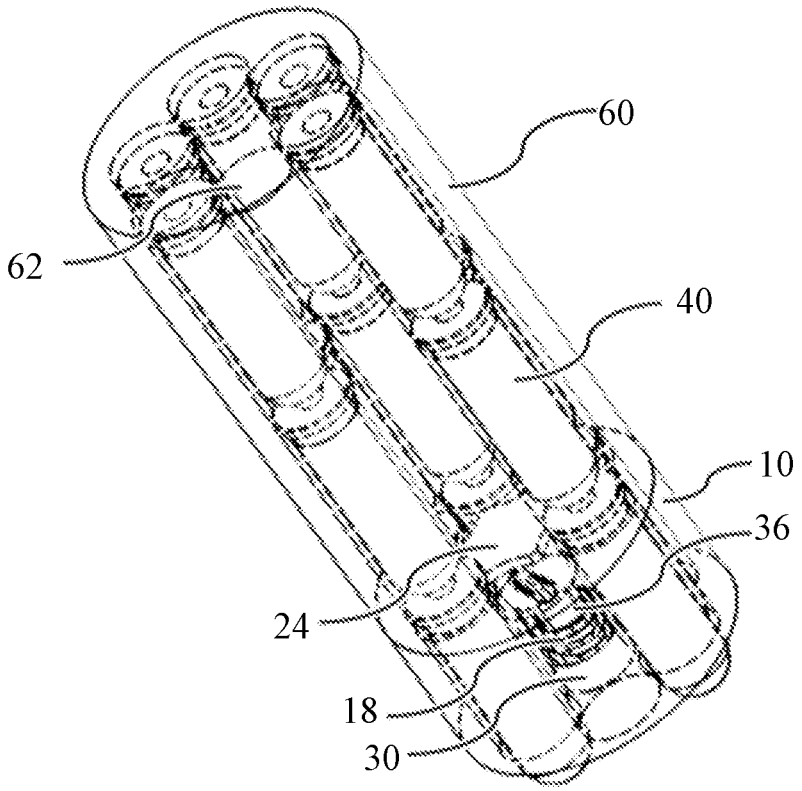
FIG. 49 is a perspective view of a speed loader and an extender.

FIG. 49 is a perspective view showing internal components of another embodiment of the speed loader 10 and extender 60. The speed loader 10 has a star-shaped disk 24, plunger shaft 36, spring 18, and button 30. One cartridge passage 62 is empty such that the components are easier to see.

Figure 50:
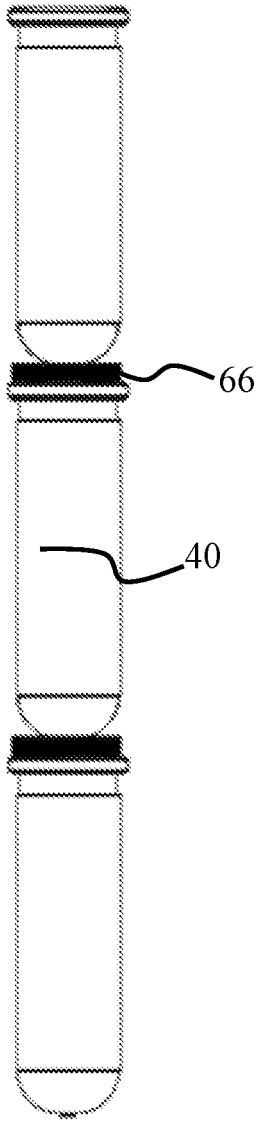
FIG. 50 is a side view of a speed loader in accordance with embodiments of the present disclosure.
Figure 51:
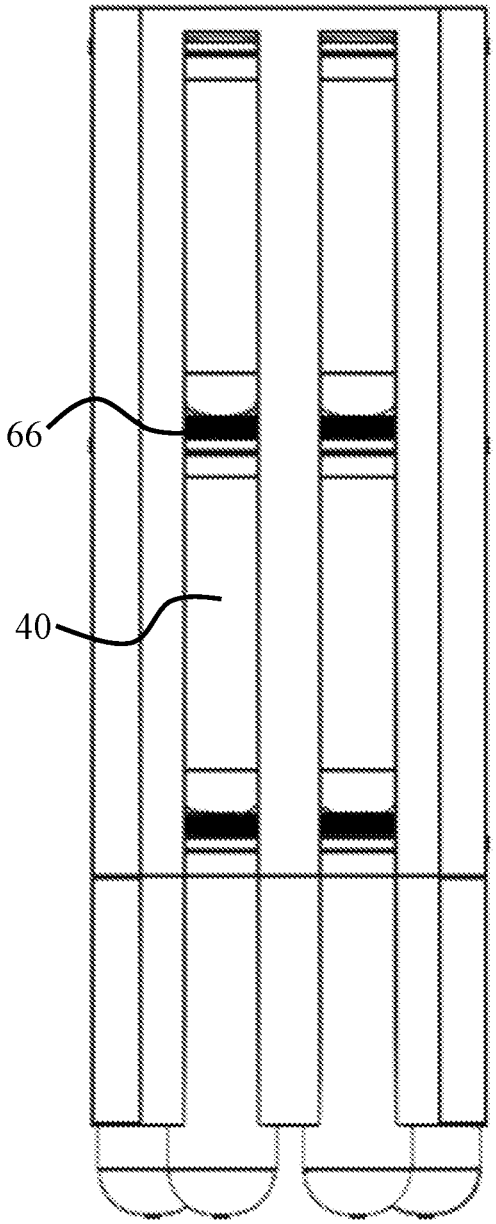
FIG. 51 is a side view of a speed loader in accordance with embodiments of the present disclosure.

FIGS. 50 and 51 show an additional feature that can be added to any embodiment described herein. Spacers 66 are positioned between the cartridges 40 for safety purposes. The spacers 66 are optional, but are an added safety measure to prevent a cartridge's projectile from coming into contact with the primer of the cartridge below. In some embodiments, the speed loader 10 does not include the spacers 66.

Figure 52:
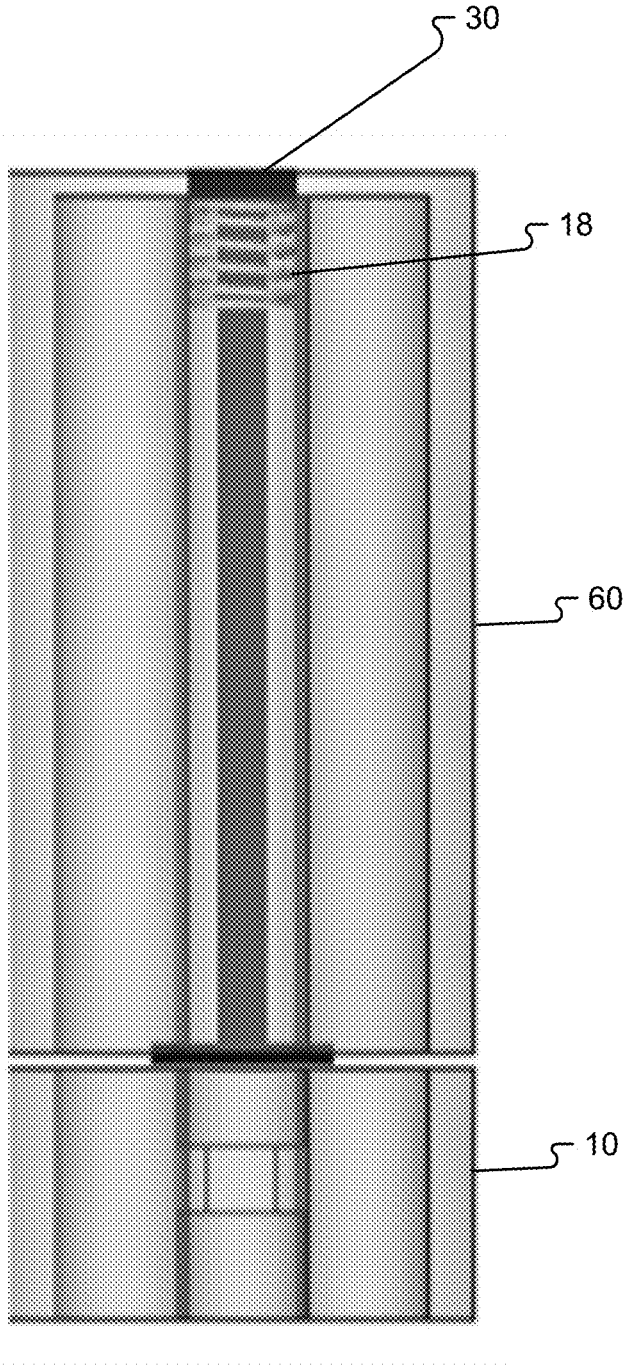
FIG. 52 is a side view of a speed loader in accordance with embodiments of the present disclosure.

FIG. 52 shows at least one embodiment of the speed loader 10 with the extender 60 and the button 30 positioned at a top of the device. It will be appreciated that the button can also be at a side of the device.

To assist in the understanding of the embodiments of the present invention, the following list of components and associated numbering found in the drawings is provided herein:

2 Firearm or revolver
4 Hand
10 Speed loader
12 Main body
14 Cover or cartridge retaining cover
16 Plunger shaft spring cavity
18 Plunger shaft spring
20 First end of main body (by revolver cylinder)
22 Second end of main body (by cover or extender)
23 Longitudinal Axis
24 Disk or Rotating disk or Cartridge securing disk
26 Cylinder Cavity
27 Space
28 Pin or T portion or Protrusions
30 Button
32 Disk Cylinder
34 Slot in disk cylinder
36 Plunger Shaft
38 Ratchet Cutout
40 Cartridges
42 Passages in speed loader for cartridges
44 Button Cavity
46 Cartridge Flange or Rim
50 Revolver cylinder
52 Revolver cylinder ratchet
54 Plunger shaft cavity, narrow portion
56 Radially Extending Portions or Arms of Disk
58 Cone-shaped Cavity
60 Extender or speed loader extension
62 Passages in extender for cartridges
64 Aperture
66 Spacer The corresponding structures, materials, acts, and equivalents of all means or step plus function elements in the claims below are intended to include any structure, material, or act for performing the function in combination with other claimed elements as specifically claimed. The description of the present disclosure has been presented for purposes of illustration and description, but is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated.

While the preferred embodiment to the invention had been described, it will be understood that those skilled in the art, both now and in the future, may make various improvements and enhancements which fall within the scope of the claims which follow. These claims should be construed to maintain the proper protection for the invention first described.

Additionally, various features/components of one embodiment may be combined with features/components of another embodiment. For example, features/components of one figure can be combined with features/components of another figure or features/components of multiple figures. To avoid repetition, every different combination of features has not been described herein, but the different combinations are within the scope of this disclosure. Additionally, if details (including angles, dimensions, etc.) about a feature or component are described with one embodiment or one figure, then those details can apply to similar features of components in other embodiments or other figures.

While various embodiments of the present invention have been described in detail, it is apparent that modifications and alterations of those embodiments will occur to those skilled in the art. However, it is to be expressly understood that such modifications and alterations are within the scope and spirit of the present invention, as set forth in the following claims. Further, the invention(s) described herein is capable of other embodiments and of being practiced or of being carried out in various ways. It is to be understood that the phraseology and terminology used herein is for the purpose of description and should not be regarded as limiting.

It is to be appreciated that any feature described herein can be claimed in combination with any other feature(s) as described herein, regardless of whether the features come from the same described embodiment.

What is claimed is:

1. A speed loading device comprising:

a main body having a first end opposite a second end and a longitudinal axis therebetween;

a plurality of cartridge passages in the main body extending parallel to the longitudinal axis;

a button configured to actuate the speed loading device;

a shaft interconnected on a first end to the button;

a spring positioned around a portion of the shaft and proximate the button;

a pin interconnected to a second end of the shaft and extending outwardly in a radial direction from the shaft; and a disk comprising a plurality of arms and recesses between adjacent arms, the disk being configured to rotate when the speed loading device is actuated by the button.

2. The speed loading device of claim 1, wherein the button is positioned at the first end of the main body.

3. The speed loading device of claim 1, further comprising an extender connected to the second end of the main body, wherein the button is positioned at a top of the extender.

4. The speed loading device of claim 1, further comprising a disk cylinder connected to the disk, the disk cylinder having an angled slot, wherein the pin of the shaft is positioned in the angled slot.

5. The speed loading device of claim 4, wherein translational movement of the shaft pushes the pin along the angled slot, thereby rotating the disk cylinder and the disk between a first position and a second position.

6. The speed loading device of claim 5, wherein the spring biases the disk in the first position.

7. The speed loading device of claim 5, wherein the plurality of arms engages cartridges stored in the plurality of cartridge passages when the disk is in the first position and wherein the plurality of arms disengages the cartridges stored in the plurality of cartridge passages when the disk is in the second position.

8. The speed loading device of claim 1, further comprising a shaft cavity concentric with the longitudinal axis, in which the shaft, spring, and button are positioned in the shaft cavity.

9. A speed loading device comprising:

a main body comprising a first end opposite a second end, and a plurality of passages extending from the first end to the second end, each passage of the plurality of passages being configured to receive a cartridge;

a button movable relative to the main body and positioned proximate the first end of the main body, the button configured to actuate the speed loading device;

a shaft connected to the button and positioned within the main body;

a disk having a plurality of radially extending arms and recesses formed between adjacent arms, the disk being positioned proximate to the second end of the main body, the disk being configured to rotate;

a disk cylinder connected to the disk and the shaft, wherein translational movement of the shaft rotates the disk cylinder and the disk between a first position and a second position; and an extender connected to the second end of the main body, the extender comprising one or more additional passages configured to receive one or more rows of cartridges.

10. The speed loading device of claim 9, wherein the plurality of radially extending arms is aligned with the one or more additional passages of the extender, thereby holding cartridges in the extender when the disk is in the first position, and the recesses are aligned with the additional passages of the extender, thereby allowing cartridges in the extender to enter the plurality of passages of the main body when the disk is in the second position.

11. The speed loading device of claim 9, wherein the main body and the extender are configured to receive two rows of cartridges.

12. The speed loading device of claim 9, wherein the main body and the extender are configured to receive three or more rows of cartridges.

13. The speed loading device of claim 9, wherein the extender includes a cone-shaped cavity configured to receive the disk.

14. The speed loading device of claim 9, wherein the disk cylinder comprises at least one slot and the shaft comprises at least one pin receivable in the at least one slot, the at least one slot disposed at an angle, wherein translational movement of the shaft moves the at least one pin along the at least one slot, thereby rotating the disk cylinder.

15. The speed loading device of claim 14, wherein the plurality of radially extending arms engages cartridges stored in the plurality of passages when the disk is in the first position, and the plurality of radially extending arms disengages the cartridges stored in the plurality of passages when the disk is in the second position.

16. A speed loading device comprising:

a main body having a first end opposite a second end and a longitudinal axis therebetween;

a plurality of cartridge passages in the main body extending parallel to the longitudinal axis;

a button configured to actuate the speed loading device;

a shaft interconnected on a first end to the button;

a disk comprising a plurality of arms and recesses between adjacent arms and positioned at a second end of the shaft, the disk configured to rotate between a first position and a second position when the speed loading device is actuated by the button; and a spring positioned around a portion of the shaft and proximate the button, the spring configured to bias the disk to the first position.

17. The speed loading device of claim 16, further comprising a pin interconnected to a second end of the shaft and extending outwardly in a radial direction from the shaft.

18. The speed loading device of claim 16, further comprising a shaft cavity concentric with the longitudinal axis, in which the shaft, spring, and button are positioned in the shaft cavity.

19. The speed loading device of claim 16, further comprising a disk cylinder connected to the disk, the disk cylinder having an angled slot, wherein a pin of the shaft is positioned in the angled slot.

* * * * *